US008961708B2

(12) United States Patent
Kaiser et al.

(10) Patent No.: US 8,961,708 B2
(45) Date of Patent: Feb. 24, 2015

(54) CONDENSATE MANAGEMENT SYSTEM AND METHODS

(71) Applicant: Plexaire LLC, Wayne, NJ (US)

(72) Inventors: Stewart Kaiser, Boca Raton, FL (US); William G. Williams, Tyler, TX (US)

(73) Assignee: Plexaire, LLC, Wayne, NJ (US)

( * ) Notice: Subject to any disclaimer, the term of this patent is extended or adjusted under 35 U.S.C. 154(b) by 0 days.

(21) Appl. No.: 14/079,438

(22) Filed: Nov. 13, 2013

(65) Prior Publication Data

US 2014/0130529 A1 May 15, 2014

Related U.S. Application Data

(60) Provisional application No. 61/725,828, filed on Nov. 13, 2012, provisional application No. 61/752,364, filed on Jan. 14, 2013, provisional application No. 61/792,640, filed on Mar. 15, 2013.

(51) Int. Cl.

| | |
|---|---|
| ***F24F 13/22*** | (2006.01) |
| ***F25D 21/14*** | (2006.01) |
| ***B08B 9/032*** | (2006.01) |
| ***B08B 3/04*** | (2006.01) |

(52) U.S. Cl.

CPC ..... *B08B 9/032* (2013.01); *F25D 21/14* (2013.01); *B08B 3/04* (2013.01); *F24F 13/222* (2013.01); *F24F 2013/227* (2013.01)

USPC ..... 134/166 C; 134/167 C; 134/168 C; 134/167 R; 134/168 CR; 134/169 C; 134/169 R; 134/565.23; 62/150; 62/285; 62/286; 62/287; 62/288; 137/565.23; 137/565.25; 137/565.12

(58) Field of Classification Search

CPC ..... F25D 21/14; F25D 2321/145; F25D 2321/146; F25D 2321/14; F24F 13/22; F24F 13/222; F24F 13/224; F24F 2013/225; F24F 2013/227

USPC ..... 62/285, 291, 150, 272; 4/328, 332, 668, 4/682, 683, 426–435, 386

See application file for complete search history.

(56) References Cited

U.S. PATENT DOCUMENTS

| | | | |
|---|---|---|---|
| 1,946,182 | A | 2/1934 | Thompson |
| 2,202,406 | A | 5/1940 | Staege |

(Continued)

FOREIGN PATENT DOCUMENTS

| | | | |
|---|---|---|---|
| EP | 0593005 | A1 | 4/1994 |
| GB | 2140121 | A | 11/1984 |

(Continued)

OTHER PUBLICATIONS

TLV Internation Inc. "Bypass Valves," check valves used on bypass condensate drain lines, Mar. 28, 2010.*

(Continued)

*Primary Examiner* — Frantz Jules
*Assistant Examiner* — Meraj A Shaikh
(74) *Attorney, Agent, or Firm* — Venable LLP; Michele V. Frank

(57) ABSTRACT

A condensate management system for an air conditioning condensate drainage system is provided. The condensate management system may comprise an inlet and an outlet; a primary condensate flow path from the inlet to the outlet; a check valve disposed along the primary condensate flow path; a flush path from the inlet to the outlet; a pump coupled to the flush path; and a logic panel configured to actuate the pump to a flushing mode. The check valve may be configured to allow fluid flow from the inlet to the outlet. When the logic panel is configured to actuate the pump to the flushing mode, the pump is configured to exert a negative pressure at the inlet and a positive pressure at the outlet. Other system and methods to flush a condensate drain system are also described.

22 Claims, 21 Drawing Sheets

(56) References Cited

U.S. PATENT DOCUMENTS

| | | | | |
|---|---|---|---|---|
| 2,276,714 | A | 3/1942 | Brown | |
| 2,437,332 | A * | 3/1948 | Newton | 62/166 |
| 2,460,258 | A | 1/1949 | Jones | |
| 3,412,571 | A * | 11/1968 | Bolynn | 62/188 |
| 3,494,113 | A | 2/1970 | Kinney | |
| 3,750,001 | A | 7/1973 | McCloskey | |
| 3,921,052 | A | 11/1975 | Milano | |
| 4,122,381 | A | 10/1978 | Sturm | |
| 4,142,367 | A | 3/1979 | Guisti | |
| 4,188,862 | A | 2/1980 | Douglas, III | |
| 4,228,786 | A | 10/1980 | Frankenfield | |
| 4,352,025 | A | 9/1982 | Troyen | |
| 4,369,373 | A | 1/1983 | Wiseman | |
| 4,387,575 | A | 6/1983 | Wenzel | |
| 4,408,127 | A | 10/1983 | Santos, Sr. | |
| 4,489,290 | A | 12/1984 | Warner | |
| 4,496,845 | A | 1/1985 | Ensign et al. | |
| 4,647,373 | A | 3/1987 | Tokar et al. | |
| 4,713,209 | A | 12/1987 | Ishimaru et al. | |
| 4,808,837 | A | 2/1989 | Matthias et al. | |
| 4,937,559 | A * | 6/1990 | Meacham et al. | 340/618 |
| 4,998,412 | A | 3/1991 | Bell | |
| 5,043,592 | A | 8/1991 | Hochstrasser | |
| 5,079,495 | A | 1/1992 | Yasuo | |
| 5,085,244 | A | 2/1992 | Funk | |
| 5,201,806 | A | 4/1993 | Wood | |
| 5,271,237 | A | 12/1993 | Popelka et al. | |
| 5,293,894 | A * | 3/1994 | Fleischmann | 137/135 |
| 5,354,365 | A | 10/1994 | Youn | |
| 5,389,821 | A | 2/1995 | Moulliet | |
| 5,461,875 | A | 10/1995 | Lee et al. | |
| 5,673,851 | A | 10/1997 | Dozier et al. | |
| 5,742,515 | A | 4/1998 | Runkle et al. | |
| 5,752,393 | A * | 5/1998 | Schlosser et al. | 62/303 |
| 5,964,238 | A | 10/1999 | Junkin | |
| 5,989,303 | A | 11/1999 | Hodge | |
| 6,010,113 | A | 1/2000 | Rotering | |
| 6,041,611 | A * | 3/2000 | Palmer | 62/286 |
| 6,165,240 | A | 12/2000 | Hodge | |
| 6,182,677 | B1 | 2/2001 | Pignataro | |
| 6,276,894 | B1 | 8/2001 | Koch | |
| 6,371,631 | B1 | 4/2002 | Reutemann | |
| 6,427,458 | B1 * | 8/2002 | Fowler | 62/150 |
| 6,442,956 | B1 * | 9/2002 | Herren | 62/150 |
| 6,584,995 | B2 * | 7/2003 | Kimbrough et al. | 137/240 |
| 6,708,717 | B1 | 3/2004 | Coogle | |
| 6,730,865 | B1 * | 5/2004 | Hernandez-Zelaya | 200/84 R |
| 6,765,308 | B1 | 7/2004 | Kazanjian et al. | |
| 6,811,588 | B2 | 11/2004 | Niakin | |
| 6,971,399 | B2 | 12/2005 | Cowan | |
| 6,976,367 | B2 * | 12/2005 | Spanger | 62/129 |
| 7,032,406 | B2 | 4/2006 | Hollen et al. | |
| 7,191,606 | B1 | 3/2007 | Dwyer | |
| 7,335,999 | B2 | 2/2008 | Potter et al. | |
| 7,357,599 | B2 | 4/2008 | Cripps | |
| 7,392,658 | B1 | 7/2008 | Hardy, III | |
| 7,448,405 | B2 * | 11/2008 | Shores | 137/240 |
| 7,452,160 | B2 | 11/2008 | Cripps | |
| 7,488,364 | B1 | 2/2009 | Thomas et al. | |
| 7,501,712 | B2 | 3/2009 | Bolyard | |
| 7,632,040 | B2 | 12/2009 | Cripps | |
| 7,768,146 | B2 | 8/2010 | Balzano | |
| 7,802,942 | B2 | 9/2010 | Cripps | |
| 7,834,478 | B2 | 11/2010 | Baumann et al. | |
| 7,857,004 | B2 | 12/2010 | Pearson | |
| 7,888,590 | B2 | 2/2011 | Niederer | |
| 7,897,039 | B2 | 3/2011 | Koo | |
| 7,915,749 | B1 | 3/2011 | Chupa et al. | |
| 7,946,789 | B2 | 5/2011 | Cripps | |
| 8,002,499 | B2 | 8/2011 | Cripps | |
| 8,092,675 | B2 | 1/2012 | Kennedy | |
| 8,102,076 | B2 | 1/2012 | Baumann et al. | |
| 8,147,167 | B2 | 4/2012 | Cripps | |
| 8,147,168 | B2 | 4/2012 | Cripps | |
| 8,154,138 | B2 | 4/2012 | Ganesan et al. | |
| 8,172,092 | B2 | 5/2012 | Green et al. | |
| 8,231,327 | B2 | 7/2012 | Davis, Sr. | |
| 8,240,168 | B2 | 8/2012 | Holguin | |
| 8,294,292 | B2 | 10/2012 | Irwin et al. | |
| 8,376,656 | B2 | 2/2013 | Cripps | |
| 8,535,453 | B1 * | 9/2013 | Gonzalez | 134/166 C |
| 2001/0042792 | A1 | 11/2001 | Kline et al. | |
| 2003/0056812 | A1 | 3/2003 | Baker et al. | |
| 2004/0134533 | A1 | 7/2004 | Cowan | |
| 2004/0182451 | A1 * | 9/2004 | Poirier | 137/563 |
| 2004/0221604 | A1 * | 11/2004 | Ota et al. | 62/259.2 |
| 2005/0138939 | A1 * | 6/2005 | Spanger | 62/150 |
| 2006/0185733 | A1 * | 8/2006 | McKee | 137/216 |
| 2006/0196953 | A1 | 9/2006 | Simon et al. | |
| 2006/0260672 | A1 | 11/2006 | Niederer | |
| 2007/0028640 | A1 * | 2/2007 | Hampton | 62/280 |
| 2007/0039345 | A1 * | 2/2007 | Forsberg et al. | 62/285 |
| 2007/0175192 | A1 | 8/2007 | Niakan et al. | |
| 2007/0190927 | A1 | 8/2007 | Bash et al. | |
| 2007/0212213 | A1 | 9/2007 | Bolyard | |
| 2008/0041969 | A1 | 2/2008 | Nathan | |
| 2008/0236616 | A1 * | 10/2008 | Bloch | 134/2 |
| 2009/0084127 | A1 | 4/2009 | Nakata et al. | |
| 2009/0085400 | A1 | 4/2009 | Baumann et al. | |
| 2009/0145490 | A1 * | 6/2009 | Kershisnik | 137/334 |
| 2009/0171506 | A1 | 7/2009 | Donaldson et al. | |
| 2009/0206661 | A1 | 8/2009 | Baumann et al. | |
| 2009/0236432 | A1 | 9/2009 | Malloy | |
| 2010/0026088 | A9 | 2/2010 | Baumann et al. | |
| 2010/0026091 | A9 | 2/2010 | Baumann et al. | |
| 2010/0026100 | A1 | 2/2010 | Teggatz et al. | |
| 2010/0033015 | A1 | 2/2010 | Alvarez | |
| 2010/0096018 | A1 * | 4/2010 | Wylie et al. | 137/2 |
| 2011/0061415 | A1 * | 3/2011 | Ward | 62/291 |
| 2011/0061745 | A1 | 3/2011 | Pearson | |
| 2011/0120067 | A1 | 5/2011 | Kim | |
| 2011/0308546 | A1 * | 12/2011 | Kaiser | 134/18 |
| 2011/0308557 | A1 | 12/2011 | Kaiser | |
| 2011/0308636 | A1 | 12/2011 | Kaiser | |
| 2012/0198804 | A1 | 8/2012 | Kaiser | |
| 2012/0248206 | A1 | 10/2012 | Kaiser | |
| 2012/0261921 | A1 | 10/2012 | Kaiser | |
| 2012/0273069 | A1 | 11/2012 | Klicpera et al. | |
| 2013/0133749 | A1 * | 5/2013 | O'Leary et al. | 137/1 |
| 2013/0168304 | A1 | 7/2013 | Kania et al. | |

FOREIGN PATENT DOCUMENTS

| | | | |
|---|---|---|---|
| GB | 2382843 | A | 6/2003 |
| JP | S62-175544 | A | 8/1987 |
| JP | H02-176327 | A | 7/1990 |

OTHER PUBLICATIONS

Risko, (1996), Steam Heaters Need Complete Condensate Drainage: The condensate system may require more decisionmaking than the heater itself, Chemical Engineering, 103(7), 114, 1996.

The ICM System, The Inevitable Condensate Clog . . . causes property damage, shuts down retail revenues, and worse of all creates disgruntled customers!, http://plexaire.com/icm/, pp. 1-2.

Office Action issued in U.S. Appl. No. 12/816,430 dated Jan. 15, 2013.

Office Action issued in U.S. Appl. No. 13/023,634 dated Mar. 11, 2013.

Office Action issued in U.S. Appl. No. 13/085,227 dated Mar. Jun. 12, 2013.

Office Action issued in U.S. Appl. No. 13/073,612 dated Nov. 22, 2013.

Restriction Requirement issued in U.S. Appl. No. 12/816,430 dated Oct. 3, 2012.

Restriction Requirement issued in U.S. Appl. No. 12/958,466 dated Apr. 30, 2013.

Restriction Requirement issued in U.S. Appl. No. 12/960,752 dated Apr. 29, 2013.

PCT/US13/69912: International Search Report and Written Opinion mailed Apr. 4, 2014.

* cited by examiner

CONDENSATE MANAGEMENT SYSTEM AND METHODS

CROSS-REFERENCE TO RELATED APPLICATIONS

This application claims priority to U.S. Provisional Application Ser. No. 61/725,828, filed on Nov. 13, 2012, U.S. Provisional Application Ser. No. 61/752,364, filed on Jan. 14, 2013, and U.S. Provisional Application Ser. No. 61/792,640, filed on Mar. 15, 2013, the disclosures of which are incorporated herein by reference in their entireties.

TECHNICAL FIELD

The present invention relates generally to condensate management systems and methods and, more particularly, to systems and methods for protecting an air conditioning system from condensate flooding or overflow.

BACKGROUND

A common and well documented problem within the heating, ventilation, and air conditioning industry is the growth of a bacterial slime substance known as zooglea. As well known to one of ordinary skill in the art, zooglea may grow on walls of an air conditioning system's condensate drain pipes and narrow the drainage flowpath. Similarly, other debris or contaminants such as rust particles, hair, dirt, and other items may also build up in the condensate drain pipes. In time, zooglea or the other debris and contaminants can partially or fully obstruct condensate flow from the condensate drain pipes and cause condensate backup or flooding of the air conditioning system. These obstructions may occur in the air conditioning unit or downstream in the condensate drain pipes. Many solutions have been attempted, such as chemical treatments, manual cleanings, and drain line purging systems, but none have had great effect clearing obstructions along the entire condensate drain system flow path.

For example, clogs which form within the drain pan or upstream of a purging system are particularly difficult to remove using conventional drain line purging systems. Conventional drain line purging systems only push obstructions downstream of the purging system by creating a positive pressure. However, these conventional purging systems did little or nothing for clogs upstream of the purging system.

SUMMARY

According to an embodiment, an intelligent condensate management system is disclosed for purging and cleaning an air conditioning condensate drainage system, the intelligent condensate management system comprises a housing, the housing having an inlet and an outlet; a primary condensate flow line providing a flow path between the housing inlet and outlet, the primary condensate flow line having a check valve; a flush line providing a flow path between the housing inlet and outlet parallel to the primary condensate flow line, the flush line having a pump, wherein an inlet to the flush line is connected to a lower portion of the housing inlet; a logic panel for actuating the pump between a standby mode and a flushing mode; wherein the check valve is configured to allow flow from the housing inlet to the housing outlet; wherein actuating the pump to a flushing mode causes the check valve to close.

According to another embodiment, a method for purging a condensate drainage system for an air conditioning system is disclosed, wherein the air conditioning system comprises a compressor, an evaporator, a condenser, and a fan, the method comprising providing the condensate drainage system with a check valve in a primary condensate flow line and a pump in a flush line; wherein the flush line and primary condensate flow line are parallel to each other and an inlet to the flush line is connected to a lower portion of the primary condensate flow line; providing a check valve in the primary condensate flow line; providing a pump in the flush line; alerting a logic panel to a condition for flushing the condensate drainage system; energizing the pump, wherein the pressure differential caused by the pump causes the check valve to close; de-energizing the pump after a predetermined period of time; determining whether the condition for flushing the condensate drainage system is resolved.

According to other embodiments, the method may further comprise connecting the inlet of the flush line to a lower portion of the primary condensate flow line, flowing fluid through the flush line parallel with the primary condensate flow line, detecting an elevated condensate level in the drain pan, and/or providing the flush line, the check valve, and the pump in a housing. The condition for flushing may comprise a predetermined time interval between flushings. The energizing the pump may comprise energizing the pump for a predetermined time period. The energizing the pump for the predetermined time period may further comprise de-energizing and energizing the pump a predetermined number of times. The determining whether the condition for flushing the condensate drainage system is resolved may further comprise detecting a fluid level in the drain pan after energizing the pump and/or detecting a fluid level in the drain pan after de-energizing the pump.

According to another embodiment, a condensate management system for purging and cleaning an air conditioning condensate drainage system is disclosed, wherein the condensate management system comprises a housing having a housing inlet and a housing outlet; a primary condensate flow line from the housing inlet to the housing outlet having a check valve therein; a flush line having a pump, wherein the flush line is fluidly connected from the housing inlet to the housing outlet; a logic panel configured to actuate the pump between a standby mode and a flushing mode in order to exert a negative pressure at the housing inlet and a positive pressure at the housing outlet.

Further aspects, objectives, and advantages, as well as the structure and function of embodiments, will become apparent from a consideration of the description, drawings, and examples.

BRIEF DESCRIPTION OF THE DRAWINGS

The features and advantages of the embodiments will be apparent from the following drawings wherein like reference numbers generally indicate identical, functionally similar, and/or structurally similar elements.

DETAILED DESCRIPTION

Embodiments of the invention are discussed in detail below. In describing embodiments, specific terminology is employed for the sake of clarity. However, the invention is not intended to be limited to the specific terminology so selected. A person skilled in the relevant art will recognize that other equivalent parts can be employed and other methods developed without departing from the spirit and scope of the invention.

As will be described in more detail with the following embodiments, the system and methods are directed to a condensate management system. The condensate management system may be integrated into drainage piping of a heating, ventilation, and cooling system. The system may generally include the use of multiple flow lines, a pump, a check valve, and combinations thereof to induce both positive and negative pressures in the drainage piping in order to dislodge clogs or obstructions and/or maintenance.

Figure 1:
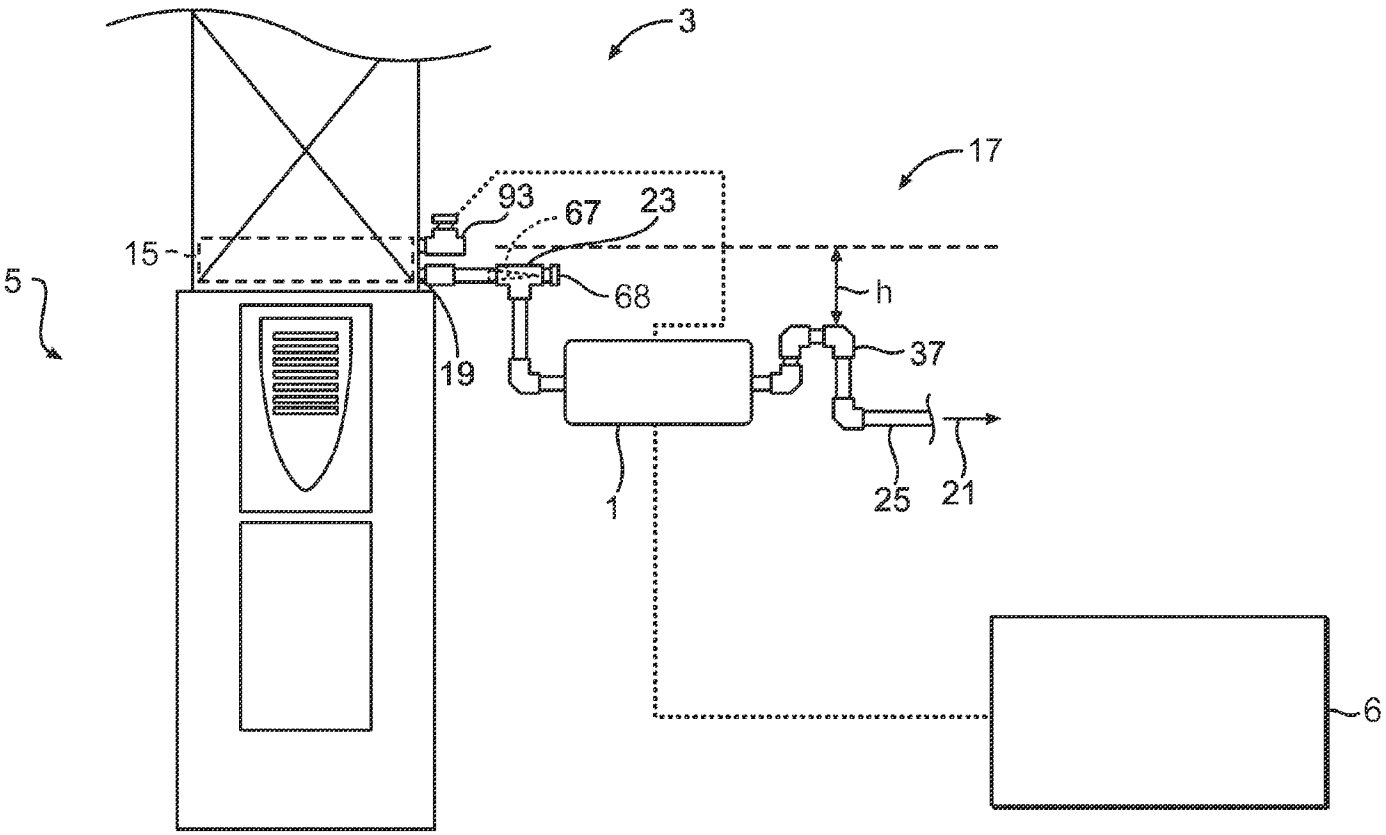
FIG. 1 is a plan view of a drainage system having an intelligent condensate management system according to an embodiment.

Referring now to FIG. 1, an air conditioning unit 3 and drainage system 17 having and intelligent condensate management system (ICM) 1 is illustrated such that the ICM 1 is preferably submerged in condensate or fluid in the drainage system 17 during normal flow through the drainage system or when a clog develops in the drainage system 17. In order to maintain the ICM 1 submerged in condensate or fluid, a downstream trap 37 is located in the downstream drainage portion 25. According to an embodiment, the downstream trap 37 has a 2-inch vertical difference from the drainage system inlet 19 at the air handler 5 to the upper elevation of the downstream trap 37. This difference is noted by reference h. However, other vertical drops, either greater than or less than the 2-inch vertical drop, are contemplated by various embodiments. For example, the upper elevation of the downstream trap 37 may be at or a distance above the ICM 1, but, preferably the elevation of the downstream trap 37 is below the level of the drain pan 15 in the air handler 5.

Figure 2:
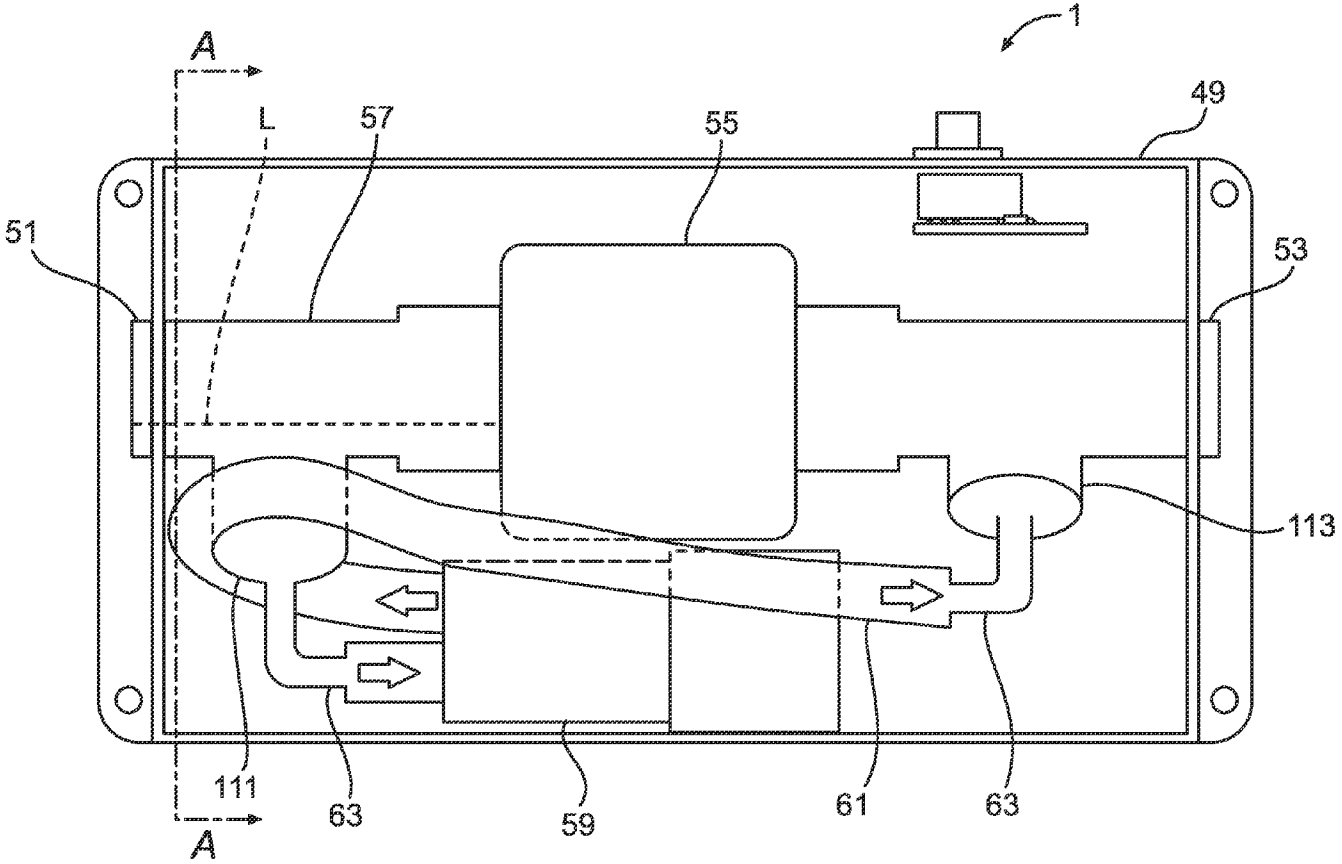
FIG. 2 is a condensate management system according to an embodiment.

Referring now to FIG. 2, an embodiment of an ICM 1 is illustrated. The ICM 1 generally comprises an ICM housing 49 with an ICM inlet 51, an ICM outlet 53, a check valve 55 in an ICM primary condensate flow line 57, and a pump 59 in an ICM flush line 61. The check valve 55 allows flow from the ICM inlet 51 to the ICM outlet 53. According to an embodiment the pump inlet 111 to the ICM flush line 61 may be arranged at a lower portion of the ICM inlet 51 such that the pump inlet 111 is below a condensate or fluid level in the ICM inlet 51. For example, the fluid level in the ICM inlet 51 may be at level L in the piping such that even during low flow conditions through the drainage system 17 (FIG. 1), the pump inlet 111 will preferentially fill with fluid due to gravity flow of the fluid.

Referring again to FIG. 1, the upper elevation of the downstream trap 37 may set the fluid level in the upstream drainage portion 23 as fluid in the drainage system will tend to equalize. Thus, the trap 37 will cause the ICM 1 to be submerged in fluid. According to another embodiment of the present invention, the upper elevation of the downstream trap, and the resulting fluid level at the upstream drainage portion 23, may be adjusted to be at or above the height of the check valve 55, ICM inlet 51, ICM primary condensate flow line 57, pump inlet 111, and/or pump 59 illustrated in FIG. 2.

Referring now to FIG. 2, the pump 59 may be located adjacent the pump inlet 111 in order to minimize the length of the pump inlet 111 piping or flexible hose 63. The pump 59 may also be located at a lower elevation than the pump inlet 111 in order to achieve greater suction head to the pump 59 and increased pump efficiency. According to an embodiment, the pump outlet 113 may be located at a lower portion of the ICM outlet 53 in order to achieve less discharge head and decreased pump loading. As explained in greater detail below, actuating the pump causes a low pressure at the ICM inlet 51 and high pressure at the ICM outlet 53. In turn, the pressure differential between the ICM inlet 51 and ICM outlet 53 causes the check valve 55 to close and the pump 59 will achieve the low pressure in the upstream drainage portion 23 (FIG. 1) and the high pressure in the downstream drainage portion 25 (FIG. 1) to maintain or unclog the drainage system 17 (FIG. 1).

Figure 3:
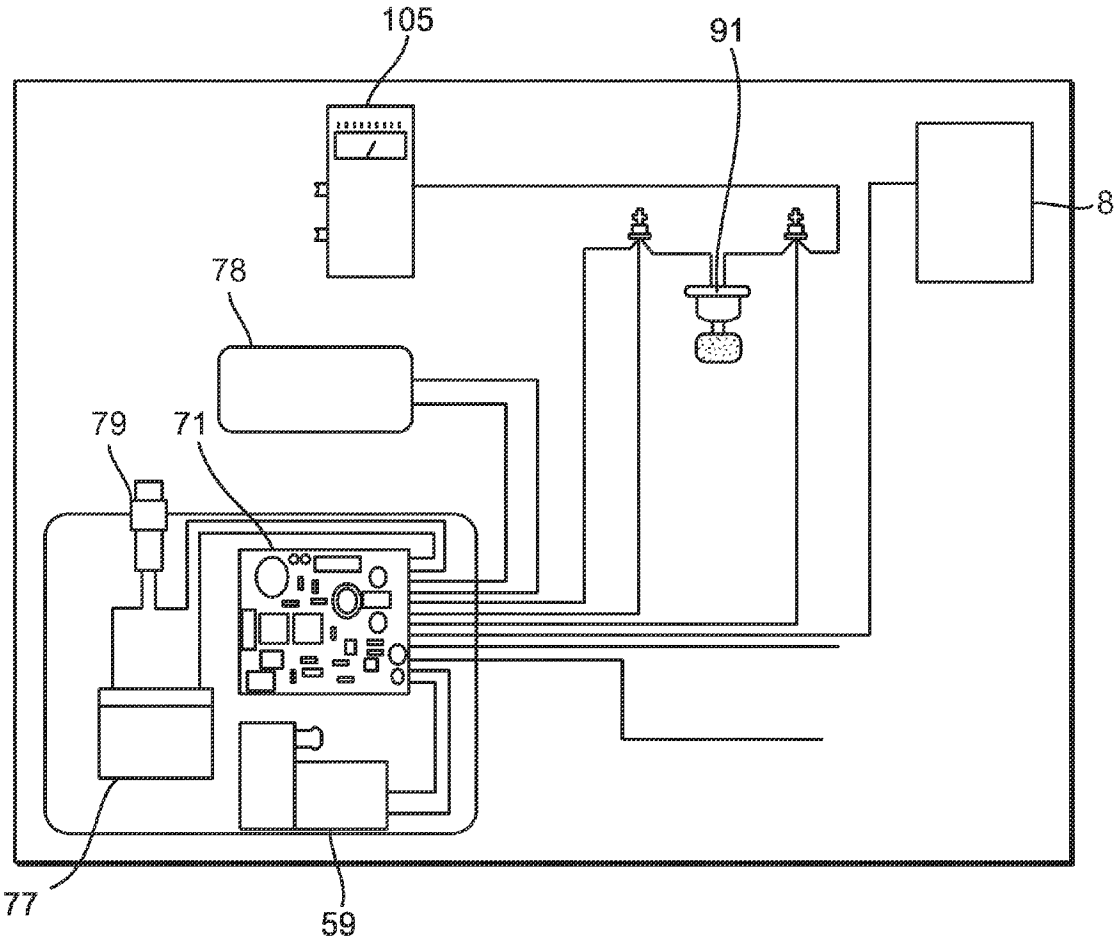
FIG. 3 is a block circuit diagram according to an embodiment.

Referring now to FIG. 3, a circuit diagram is illustrated that may be used with the ICM 1. The circuit may include a controller or logic board 71 in communication with, for example, but not limited to, a thermostat 105, float switch 91, pump 59, power sources 77 and 78, compressor relay 8, and a fuse 79. The power sources 77 and 78 may be, for example, a 12 volt battery and a 24 volt AC power source, respectively. As explained in further detail below, the controller may be configured to operate the ICM 1 according to various sequences in order to maintain or de-clog the drainage system 17. According to an embodiment, the logic board 71 may be housed within a housing of the ICM 1, such as, for example, illustrated at FIG. 7. As illustrated at FIG. 2, the logic board 71 in the ICM 1 may establish communication with the float switch 91 and condensing unit 6 of the air conditioning system such as by direct communication or via compressor relay 8. The communication may be wired, fiber optic, wireless, blue tooth, or other medium of direct or indirect communication.

Air Conditioning and Drainage System Configuration

Referring now to FIGS. 4-7, there are shown various configurations of an air conditioning system and condensate drainage system having an ICM 1. As known to one of ordinary skill in the art, the air conditioning unit 3 generally comprises an air handler 5 having a fan blower 7, evaporator coil 9, compressor (not shown), and condenser (not shown) therein. The fan blower 7 urges air from an air return 11 of the air handler 5, across the evaporator coil 9, and to an air supply 13 of the air handler 5. As air is drawn across the evaporator coil 9, condensate is formed thereat and flows into a condensate drain pan 15. In turn, condensate collected in the condensate drain pan 15 flows out of the air handler 5 and into a condensate drainage system 17 having the ICM 1. According to an embodiment, an inlet 19 of the condensate drainage system 17 is generally at an elevation above an outlet 21 of the condensate drainage system 17 in order to allow condensate to gravity drain away from the drain pan 15. Hereinafter, the portion of the condensate drainage system 17 between the drainage system inlet 19 and the ICM 1 is referred to as the upstream drainage portion 23; the portion of the condensate drainage system between the drainage system outlet 21 and the ICM 1 is referred to as the downstream drainage portion 25.

Figure 4:
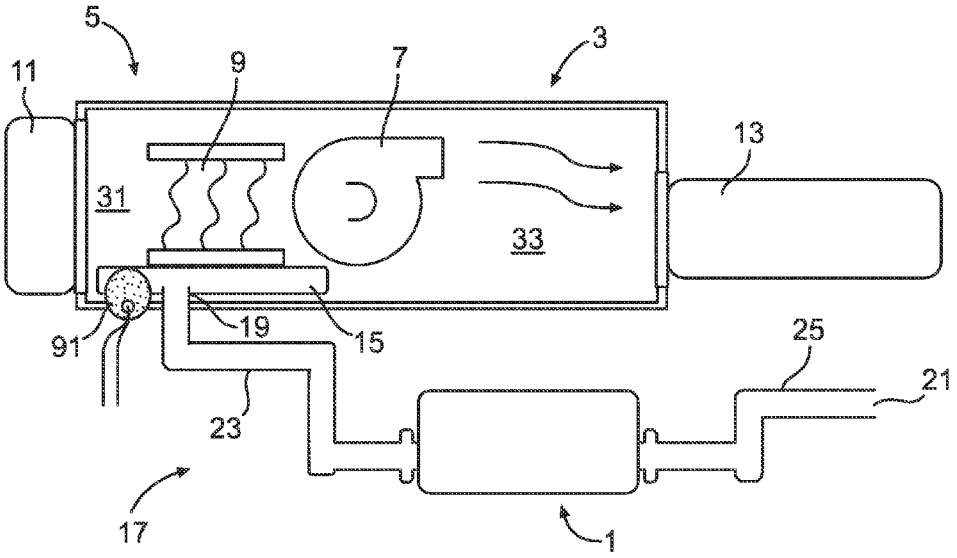
FIG. 4 is a plan view according to an embodiment.
Figure 5:
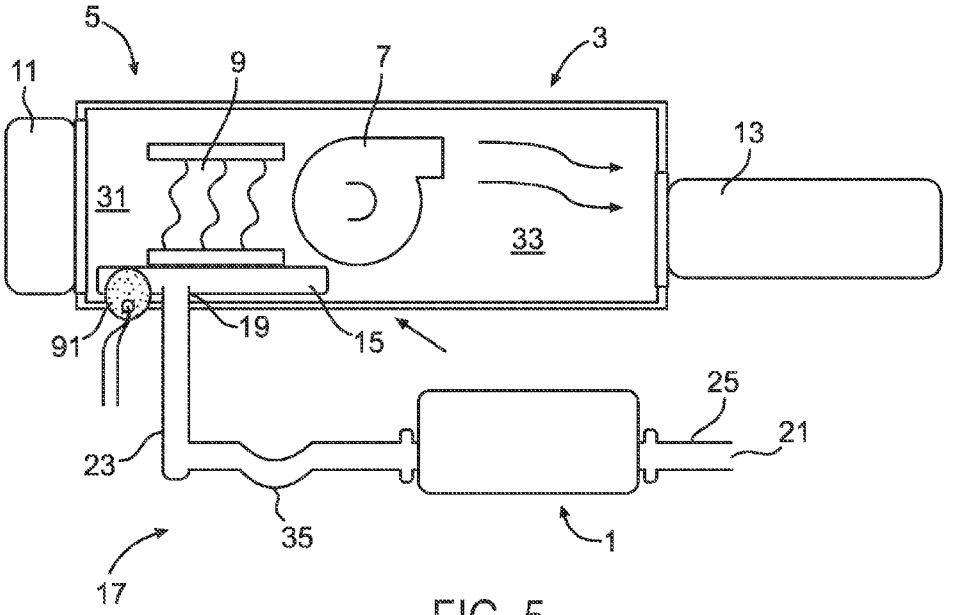
FIG. 5 is a plan view according to an embodiment.
Figure 6:
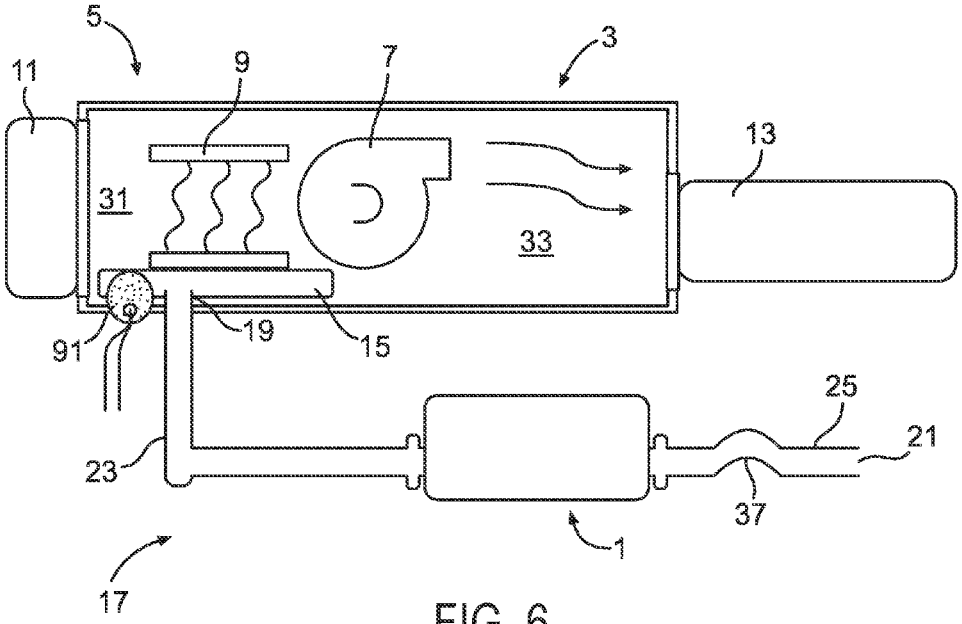
FIG. 6 is a plan view according to an embodiment.

Referring now to FIGS. 4-6, a negative pressure-type air conditioning unit configuration is illustrated. In general, the air conditioning units 3 of these illustrated embodiments use the fan blower 7 to create a vacuum at the fan blower suction 31 to pull air across the evaporator coil 9. As a result, the drainage system 17 may be subject to the vacuum or negative pressure from the fan blower 7.

Referring now to FIG. 4, an embodiment of a drainage system 17 is illustrated. According to this embodiment, the ICM 1 may be installed at an elevation below the elevation of the drainage system inlet 19 and the drainage system outlet 21. In effect, the relative elevations of the upstream drainage portion 23, downstream drainage portion 25, and ICM 1 form a condensate trap wherein condensate is trapped at the elevation of the ICM 1, thus submerging the ICM 1 in condensate. As discussed below, the ICM 1 may operate advantageously when submerged in condensate.

Referring now to FIG. 5, an embodiment of a drainage system 17 is illustrated. According to this embodiment, the ICM 1 may be installed at an elevation below the elevation of the drainage system inlet 19 and approximately at or above the elevation of the drainage system outlet 21. The upstream drainage portion 23 may include an upstream trap 35. For example, the upstream trap 35 may be a p-trap or other type of trap, as known to one of ordinary skill in the art. The upstream trap 35 may trap condensate between the upstream drainage portion 23 and the drainage system inlet 19. In effect, the upstream trap 35 isolates the ICM 1 from the negative pressure at the drainage system inlet 19 from the fan blower 7. As discussed below, the ICM 1 may operate advantageously when isolated from the negative pressure from the fan blower 7.

Referring now to FIG. 6, an embodiment of a drainage system 17 is illustrated. According to this embodiment, the ICM 1 may be installed at an elevation below the elevation of the drainage system inlet 19 and approximately at or above the elevation of the drainage system outlet 21. The downstream drainage portion 25 may include a downstream trap 37. For example, the downstream trap 37 may be an inverted p-trap or other type of trap, as known to one of ordinary skill in the art. In effect, the downstream trap 37 may trap condensate between the downstream trap 37 and the drainage system inlet 19 wherein condensate may be trapped at the elevation of the ICM 1 thus submerging the ICM 1 in condensate. As discussed below, the ICM 1 may operate advantageously when submerged in condensate.

Figure 7:
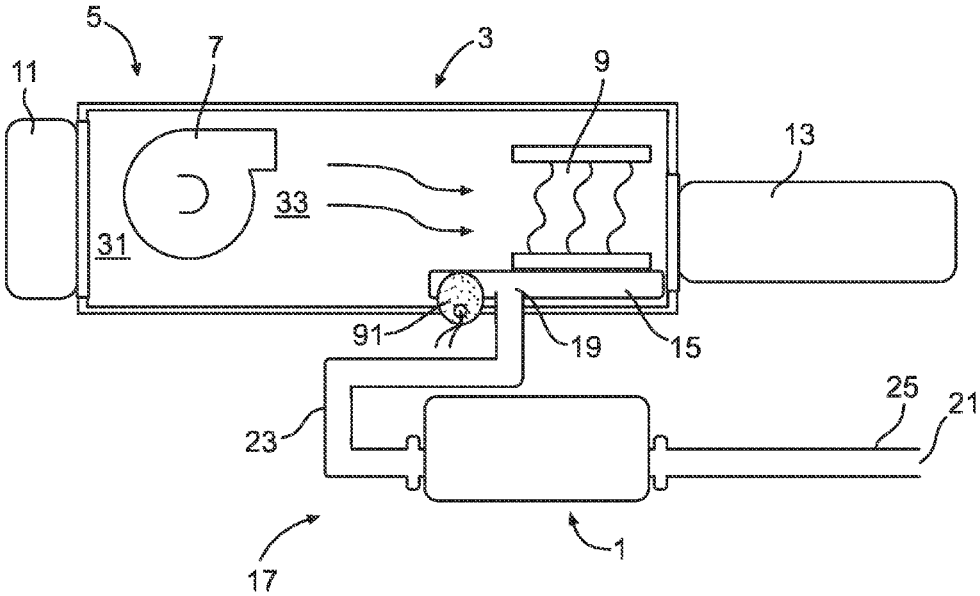
FIG. 7 is a plan view according to an embodiment.

Referring now to FIG. 7, in an alternative embodiment, a positive pressure-type air conditioning unit configuration is illustrated. In particular, the air conditioning unit 3 uses the fan blower 7 to create a positive pressure at the fan blower discharge 33 to push air across the evaporator coil 9. As a result, the drainage system 17 may be subject to the positive pressure from the fan blower 7.

Still referring to FIG. 7, according to this embodiment, the ICM 1 may be installed at an elevation below the elevation of the drainage system inlet 19 and approximately at or above the elevation of the drainage system outlet 21. Alternatively, depending on the positive pressure from the fan blower 7, the ICM 1 may be installed below the elevation of the drainage system outlet 21 or above the elevation of the drainage system inlet 19. The positive pressure from the fan blower 7 pushes condensate through the drainage system 17. According to an embodiment, no traps are installed on the upstream drainage portion 23 or the downstream drainage portion 25. However, according to another embodiment illustrated in FIG. 4, an upstream trap 35 and/or a downstream trap 37, as described above and discussed below, may cause the ICM 1 to operate advantageously.

Figure 8:
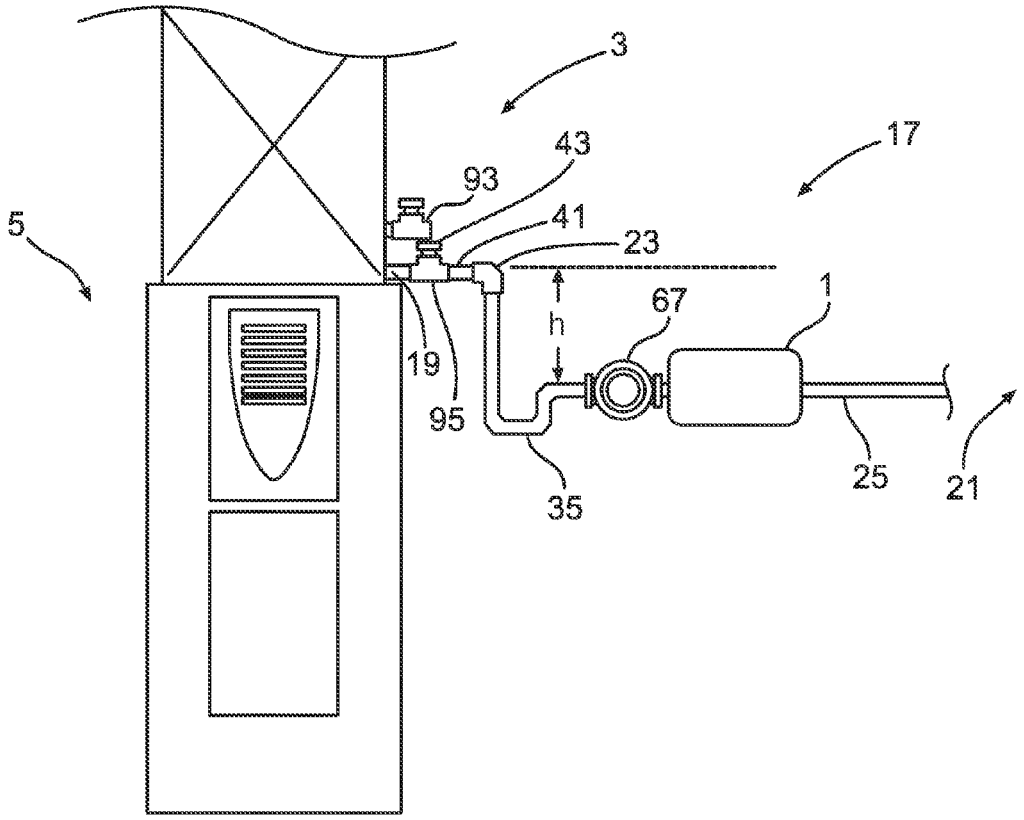
FIG. 8 is a plan view of a drainage system having an intelligent condensate management system according to an embodiment.
Figure 9:
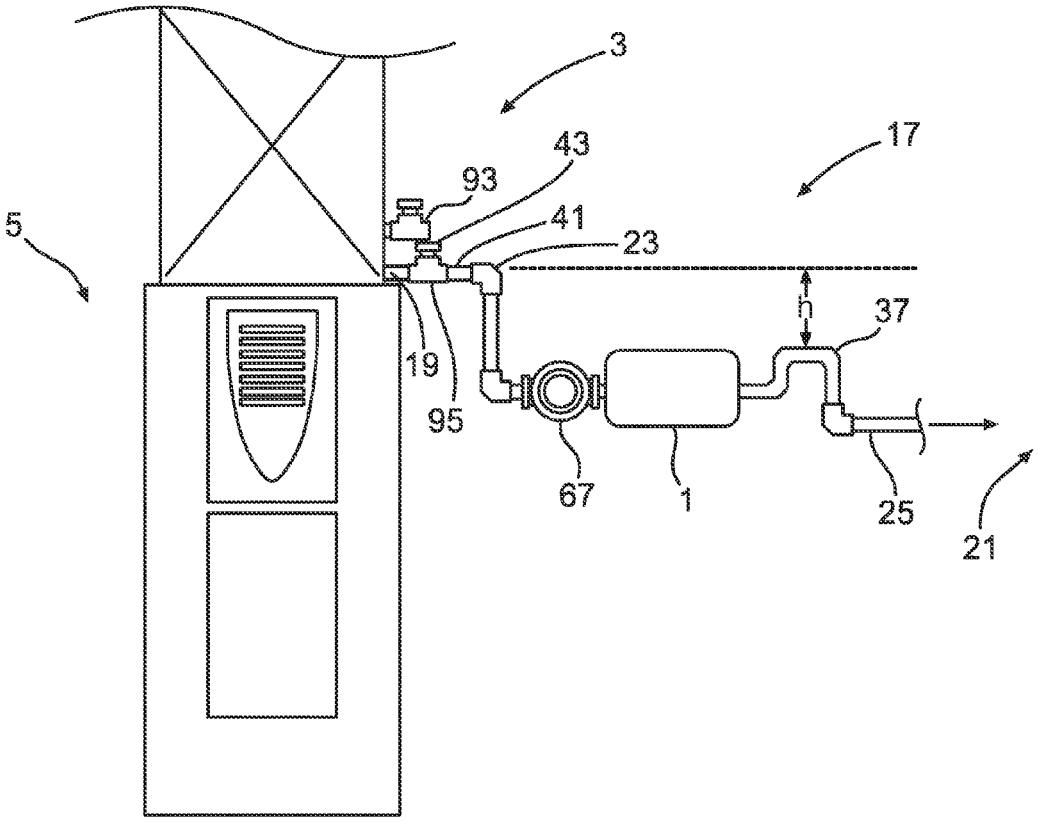
FIG. 9 a plan view of a drainage system having an intelligent condensate management system according to an embodiment.

Referring now to FIGS. 8 and 9, embodiments of the air conditioning unit 3 and drainage system 17 are illustrated, for example, as installed in a home. Specifically referring now to FIG. 8, a negative pressure-type air conditioning unit, such as, for example, a down flow furnace, configuration is illustrated in combination with a drainage system 17, such as, for example, the drainage system illustrated in FIG. 5. By example, according to an embodiment, the upstream trap 35 has preferably at least a 4-inch vertical drop from the drainage system inlet 19 at the air handler 5 to the elevation of the ICM 1. However, other vertical drops, either greater than or less than the 4-inch vertical drop, are contemplated by embodiments. According to an embodiment, no downstream traps are included in the downstream drainage portion 25 such that air may vent freely to the drainage system outlet 21. Additionally, the upstream drainage portion 23 may be provided with a clear or transparent upstream drainage portion 41 and an upstream clean out cap 43 for observing condensate flow or obstructions and cleaning the upstream drainage portion, respectively.

Referring now to FIG. 9, a positive pressure-type air conditioning unit, such as, for example, an up flow furnace, configuration is illustrated in combination with a drainage system 17, such as, for example, the drainage system illustrated in FIG. 7. However, according to the embodiment illustrated in FIG. 9, a downstream trap 37, such as an inverted p-trap, is provided at the downstream drainage portion 25. By example, according to an embodiment, the downstream trap 37 has preferably at least a 2-inch vertical drop h from the drainage system inlet 19 at the air handler 5 to the upper elevation of the downstream trap 37. However, other vertical drops, either greater than or less than the 2-inch vertical drop, are contemplated by embodiments. According to an embodiment, no traps are included downstream of the downstream trap 37 such that air may vent freely to the drainage system outlet 21.

Pump and Valve Configuration

Figure 10:
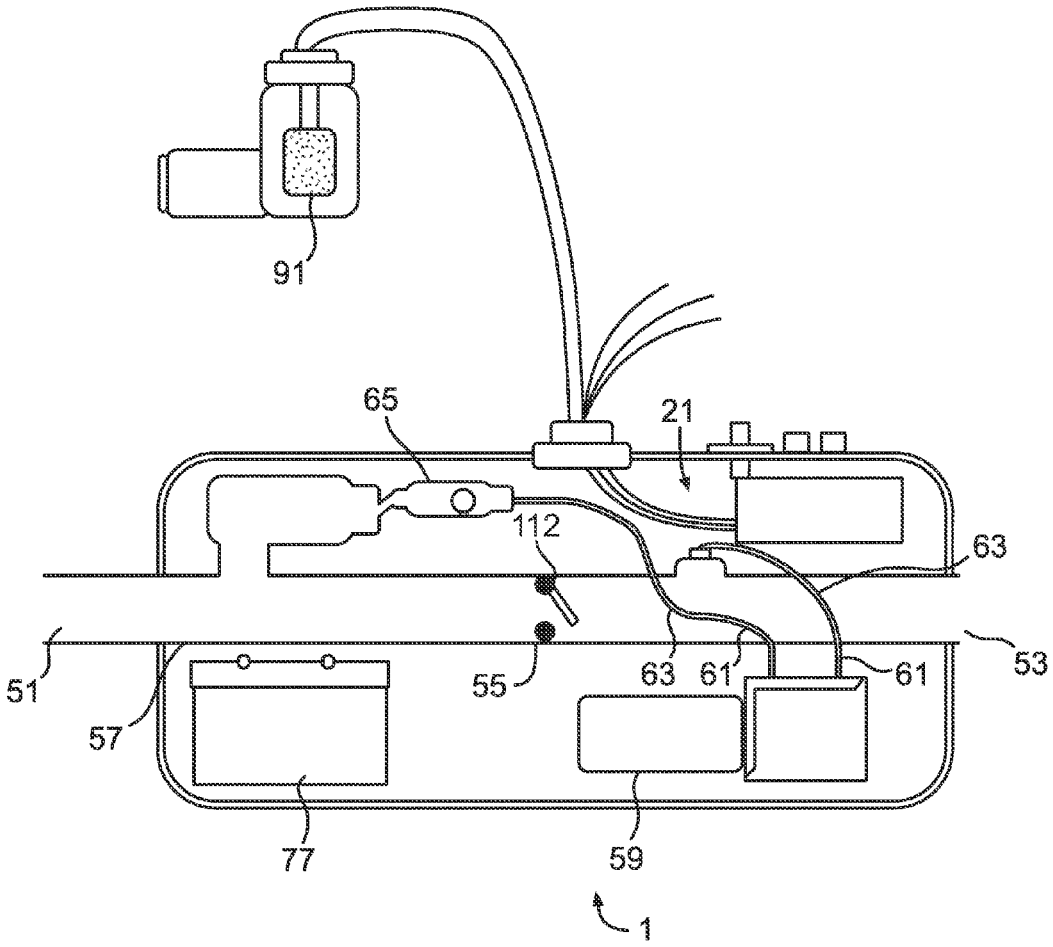
FIG. 10 is an intelligent condensate management system according to an embodiment.

Referring now to FIG. 10, an embodiment of the ICM 1 is illustrated. The ICM 1 generally comprises an ICM housing having an ICM inlet 51, an ICM outlet 53, a check valve 55 in an ICM primary condensate flow line 57, and a pump 59 in an ICM flush line 61, wherein the ICM primary condensate flow line 57 and the ICM flush line 61 are in parallel with respect to each other and share the common ICM inlet 51 and ICM outlet 53. The ICM inlet 51 connects to the upstream drainage portion 23. The ICM outlet 53 connects to the downstream drainage portion 25. According to other embodiments, the ICM flush line 61 may connect to the upstream drainage portion 23 and/or the downstream drainage portion 25 while maintaining a parallel flow relationship with the ICM primary condensate flow line 57.

The check valve 55 is configured to normally allow condensate to flow from the ICM inlet 51 to the ICM outlet 53. According to some embodiments, the check valve 55 may be a swing or flapper-type check valve. For example, the flapper-type check valve may allow normal flow through the system while exerting little backpressure. For example, during normal condensate draining conditions, the flow of condensate from the ICM inlet 51 to the ICM outlet 53 urges the check valve 55 to the open position to allow the condensate to flow to a drainage location. Upon a backflow condition where condensate begins flowing from the ICM outlet 53 to the ICM inlet 51, the backflow of condensate urges the check valve to a closed position thereby protecting condensate from flooding into the drain pan 15 and air handler 5. Thus, the check valve 55 may protect the air conditioning unit 3 from damage due to condensate backflow. Because the check valve 55 is actuated from the hydraulic process flow of the condensate, no externally powered actuator is required to actuate the check valve 55. For example, a manual valve or an electric solenoid valve requires external electricity or manual input. Thus, even upon loss of power to the air conditioning unit 1 and associated equipment or when no personnel is present, protection from backflow from the drainage system 17 is maintained. According to other embodiments, other check valves may be used such as, for example, a ball check valve, a diaphragm check valve, a stop-check valve, an in-line check valve, or other check valves as known to one of ordinary skill in the art.

According to an embodiment, the angle of the flapper of the flapper-type check valve may be adjusted in order to adjust the response time of the check valve during back flow conditions. For example, a substantially horizontal flapper may be adjusted to a ½ inch pitch in order to increase the response time of the check valve during back flow conditions to 1.5 seconds to 3.5 seconds to fully close the check valve.

The pump 59 may be a water, air, or hybrid water/air pump. According to other embodiments, other types of pumps may be used such as, for example, a diaphragm pump or other types of pumps as known to one of ordinary skill in the art. According to an embodiment, the pump 59 may be capable of pumping air, water, chemicals and/or gases, liquids, and debris. The pump 59 in the ICM flush line 61 may be connected to the ICM inlet 51 and ICM outlet 53 with flexible hoses 63 thereby allowing compact assembly of the ICM 1. Alternatively, the pump 59 may be connected with rigid piping or tubing to provide structural integrity to the assembly of the ICM 1. Additionally, the inlet of the pump 59 may be provided with a check valve 61 to prevent back flow through the pump 59. For example, the check valve 61 may be a ball check valve, a diaphragm check valve, a stop-check valve, an in-line check valve, or other check valves as known to one of ordinary skill in the art. Alternatively, according to another embodiment, no check valve may be provided at the inlet of the pump 59.

According to some embodiments, as explained above, the check valve 55 may be isolated from negative pressure from the fan blower 7 in a negative pressure-type air conditioning unit in order to avoid negative pressure from closing the check valve 55. In a flow profile of the upstream drainage portion 23 having a condensate level and an air gap thereabove, negative pressure may urge the check valve 55 to the closed position even while condensate is flowing through the drainage system 17. Isolating the check valve 55 from the negative pressure at the system inlet 19 with, for example, the upstream trap 35, prevents such negative pressure from affecting operation of the check valve 55.

Similarly, the check valve 55 may be isolated from the positive pressure from a positive pressure-type air conditioning unit. In a flow profile of the upstream drainage portion 23 having a condensate level and an air gap thereabove, positive pressure may urge the check valve 55 to the open position even while, for example, condensate is back flowing through the check valve 55. Isolating the check valve 55 from the positive pressure at the system inlet 19 with, for example, the upstream trap 35, prevents such positive pressure from affecting operation of the check valve 55.

Figure 11:
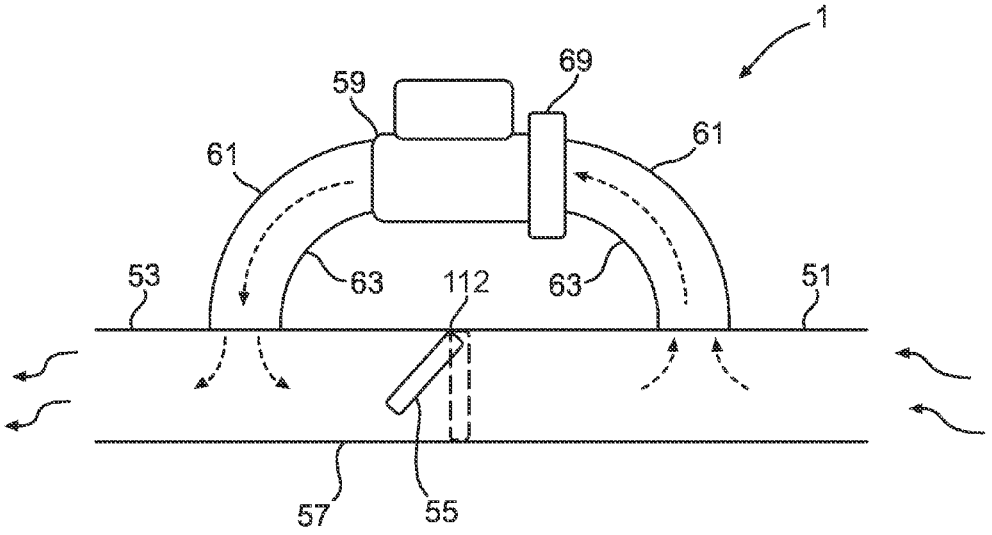
FIG. 11 is a process flow diagram of an intelligent condensate management system according to an embodiment.

Referring again to FIGS. 1, 7, and 8, a filter 67 may be installed in the upstream drainage portion 23 of the drainage system 17 to prohibit debris entering and damaging the ICM 1 and damaging the components contained therein, such as, for example, pump 59. The filter 67 may be a self-contained and installed in-line filter to collect debris in the drainage system 17. Additionally, the filter 67 may filter the condensate of metallic debris which could collect in the drain pan 15 of the air handler 5. Alternatively, according to another embodiment, no filter may be provided at upstream drainage portion 23. Referring now to FIG. 11, a filter 69 may be installed at the pump 59 inlet thereby allowing debris to flow freely through the ICM primary condensate flow line 57 during normal condensate draining conditions while the ICM 1 is in a standby mode with the pump in the OFF position.

As shown at FIG. 1, the filter 67 may be a conical-type filter held in place by plug 68 at a tee portion upstream of the ICM 1. The conical-type filter may be constructed of stainless steel and sized with a mesh large enough to inhibit zooglea growth thereon. As debris flow toward the filter 67, debris may be funneled to the center of the conical section where the mass accumulates in the filter 67 or the fluid pressure breaks the mass into smaller pieces through the mesh.

Referring now to FIG. 11, the fluid flow and/or pressure profile of the ICM 1 is shown. As explained above, during normal condensate draining conditions, the pump 59 is in an OFF configuration or standby mode and condensate generally flows through the ICM primary condensate flow line 57 from the ICM inlet 51 to the ICM outlet 53. During other conditions, such as a flooding condition or during a maintenance/ cleaning operation the pump 59 switches to an ON configuration or flushing mode and pumps condensate from the ICM inlet 51 to the ICM outlet 53 through the ICM flush line 61. As a result the pump 59 creates a negative pressure or vacuum at the ICM inlet 51 and a positive pressure at the ICM outlet 53. Similar to the backflow condition explained above, the pump 59 creates a pressure differential across the check valve 55 to cause the check valve to move to the closed position. In other words, the pump 59 causes the pressure profile across the check valve 55 to mimic that of a backflow condition and causes the check valve 55 to move to the closed position. In effect, the pump 59 and check valve 55 are actuated in series. For example, electricity is applied, as explained below, to energize the pump 59 and the pump 59, in turn, creates a differential pressure across the check valve 55 to actuate the check valve 55 to a closed position. Advantageously, the hydraulic actuation of the check valve 55 with the pressure profile created by the pump 59 minimizes the power required by the ICM 1 to flush the drainage system 17.

The negative pressure created by the pump 59 in the drain pan 15 and upstream drainage portion 23 of the drainage system 17, causes obstructions to become dislodged and be pumped through the drainage system 17. In the downstream drainage portion 25 of the drainage system 17, the positive pressure created by the pump 59 will force obstructions to become dislodged and be pumped through the drainage system 17 by forcing condensate against the obstruction. Therefore, actuation of pump 59 to an ON configuration applies negative and positive pressure to the upstream drainage portion 23 and downstream drainage portion 25, respectively, to clear the entire drainage system 17 of obstructions. When the pump 59 is de-energized or actuated to the OFF or standby mode, the check valve 55 will return to normal operation. Advantageously, any backflow of liquid immediately after the pump 59 is de-energized will be contained in the downstream drainage portion 25 by closure of the check valve 55.

As a specific example, actuation of pump 59 to an ON configuration applies positive pressure downstream of the check valve 55. In a situation where a clog in the downstream portion of the check valve 55 is not removed by the pressure exerted by the pump 59, pressure may build up in the section of the downstream drainage portion 25 between the clog and the check valve 55. When the pump 59 is de-energized or actuated to the OFF or standby mode, the check valve 55 acts as a fail-safe to prevent the pressure built up between the clog and the check valve 55 from being suddenly released upstream of the check valve 55. In contrast, an externally powered valve, either electrically or manually powered, is not a fail-safe valve. For example, in the situation where pressure is built up between the clog and the externally powered valve, the externally powered valve may be opened, regardless of downstream pressure, thus resulting in sudden release of pressure upstream of the valve and into the air handler 5. This sudden release of pressure may damage the drainage system, cause flooding in the air handler 5, and become a safety hazard. Accordingly, a check valve, or a valve that is not externally powered, in the ICM 1 provides protection from a sudden release of pressure.

According to other embodiments, a person of skill in the art will recognize that although condensate is referred to in the exemplary embodiments, any liquid may be in the system. Additionally, one of ordinary skill in the art will recognize from the present disclosure, that the pump 59 may pump air or other gases to obtain the described pressure differential across check valve 55. However, due to the generally incompressible nature of liquids, submerging the ICM 1 in condensate or liquid, including the pump 59 and check valve 55, may achieve a faster check valve 55 response time when the pump 59 is actuated to the ON position or flushing mode. Thus, the ICM 1 protects the air conditioning unit 3 from backflow conditions and flushes the entire drainage system 17 through use of the single check valve 55, as explained above. Integrating these functions into a single check valve allows for fewer parts, lighter weight, and simpler installation of the ICM 1 over the prior art installations.

Figure 12:
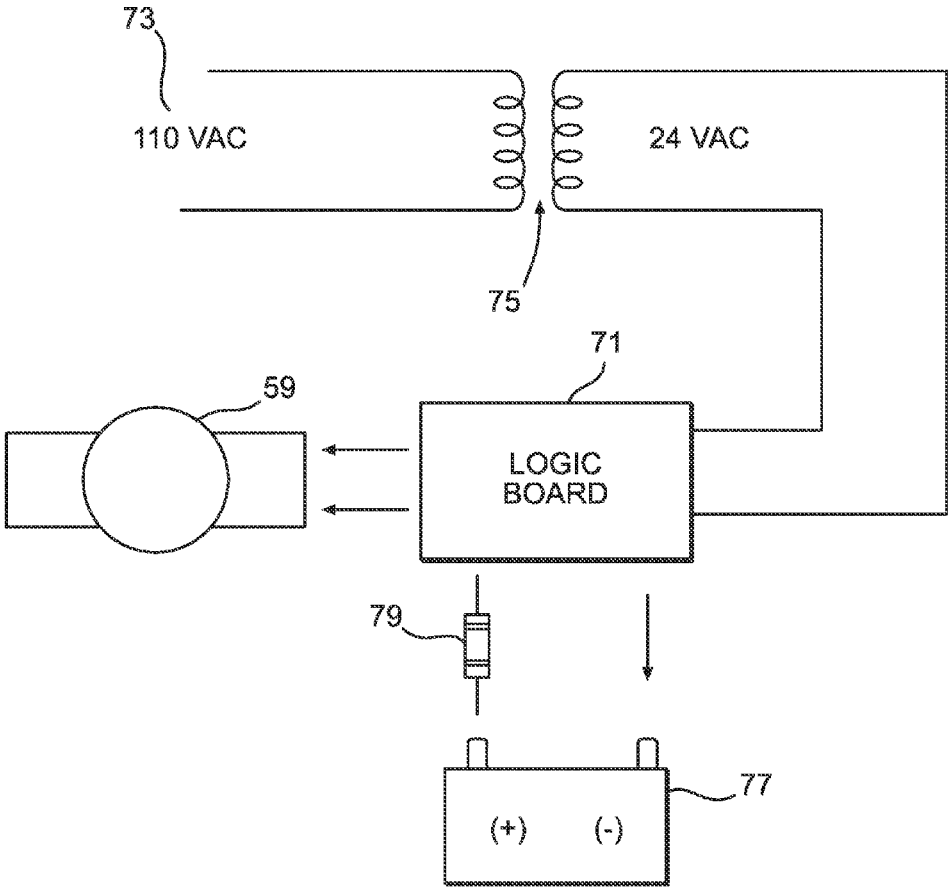
FIG. 12 is a power circuit according to an embodiment.

The pump 59, and, therefore the ICM 1, is actuated or energized through an ICM controller or logic panel 71 and associated electrical components. Referring now to FIG. 12, the ICM logic panel 71 and power circuit are illustrated. According to an embodiment, 110-volt alternating current may be provided by a power source 73 such as by, for example, a standard wall outlet. A transformer 75 steps down the power source 73 current to 24-volt alternating current. For example, the transformer 75 may be located in the furnace or air handler. The 24-volt alternating current flows to the ICM logic panel 71 where the alternating current is converted to direct current. According to an embodiment, the ICM logic panel 71 may contain, for example, a rectifier (not shown) to convert the alternating current to direct current. The ICM logic panel 71 uses the direct current to charge a battery 77 to operate the pump 59 of the ICM 1. For example, the ICM logic panel 71 may float or trickle charge the battery 77 with relatively low current. In turn, the float charged battery 77 may provide a large amount of direct current for use by the pump 59. For example, the pump 59 may operate on 10.5-15 direct current voltage with an amperage of 1.5-5 amps under large pumping loads. Further, a fuse 79 may be provided to protect the battery 77 and the ICM logic panel 71 from electrical shorts.

According to other embodiments, the pump 59 may be powered through the logic panel 71 by the power source 73. In such an embodiment, no battery is need by the ICM 1.

Referring again to FIG. 10, the ICM logic panel 71, battery 77 and transformer 75 may be contained within the ICM 1. The logic panel 71, as described in any of the embodiments herein, may be configured or programmed to actuate or energize the pump 59 according to 1) a float switch 91, 2) a preprogrammed maintenance schedule, 3) a user actuated switch 14, and/or 5) a water sensor (not shown).

In alternative embodiments, the logic panel 71 may be switch to actuate the pump the ON position. The logic panel 71 may be controlled, for example, by a button on the ICM 1 or at a location away from the ICM 1.

Figure 13:
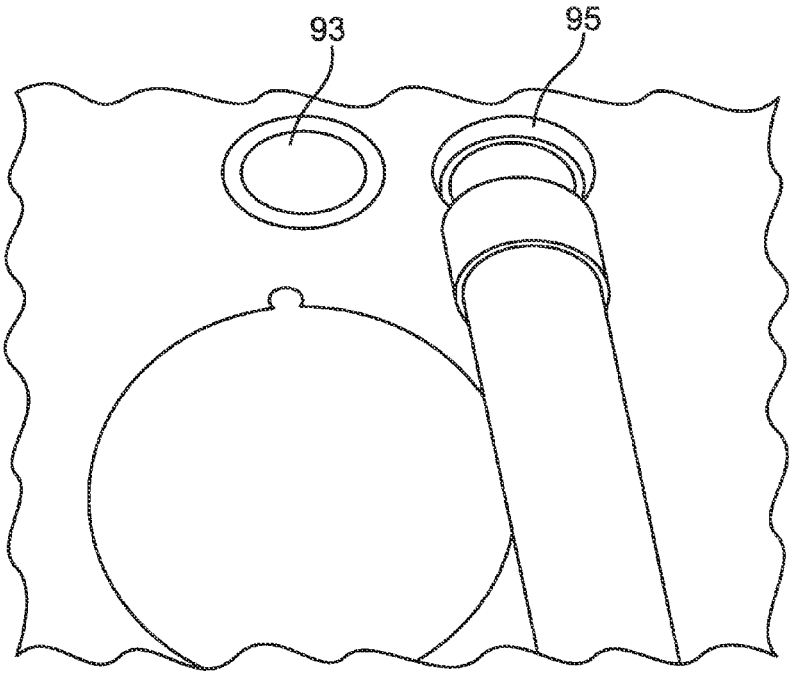
FIG. 13 shows a condensate drain location and a secondary drain location for a heating, ventilation, and air conditioning system for use in an embodiment.
Figure 14:
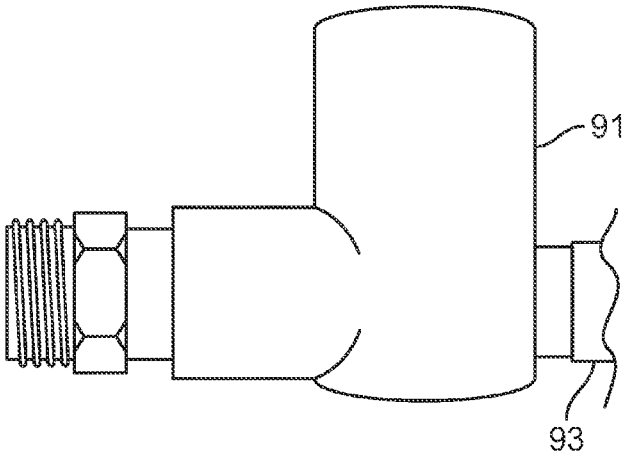
FIG. 14 is a safety switch for use in an embodiment.

Referring now to FIGS. 13 and 14, according to an embodiment, the float switch 91 may be located in the drain pan 15 of the air handler 5 and installed through a secondary drain port 93 of the air handler 5. The float switch 91 activates or alerts the ICM logic panel 71 to flush or purge the drainage system 17 when condensate in the drain pan 15 exceeds a predetermined level. Thus, an obstruction or clog at any point along the drainage system 17 will alert the ICM logic panel 71. According to another embodiment, the float switch 91 may be located in a primary drain port 95 of the air handler 5 if, for example, a secondary drain port is unavailable.

Similarly, water sensors (not shown) may be provided in the air handler 5, drain pan 15, or external to the air conditioning unit 3 to alert the ICM logic panel 71 of the presence of water or liquid.

Operating Sequences of the ICM

Figure 15:
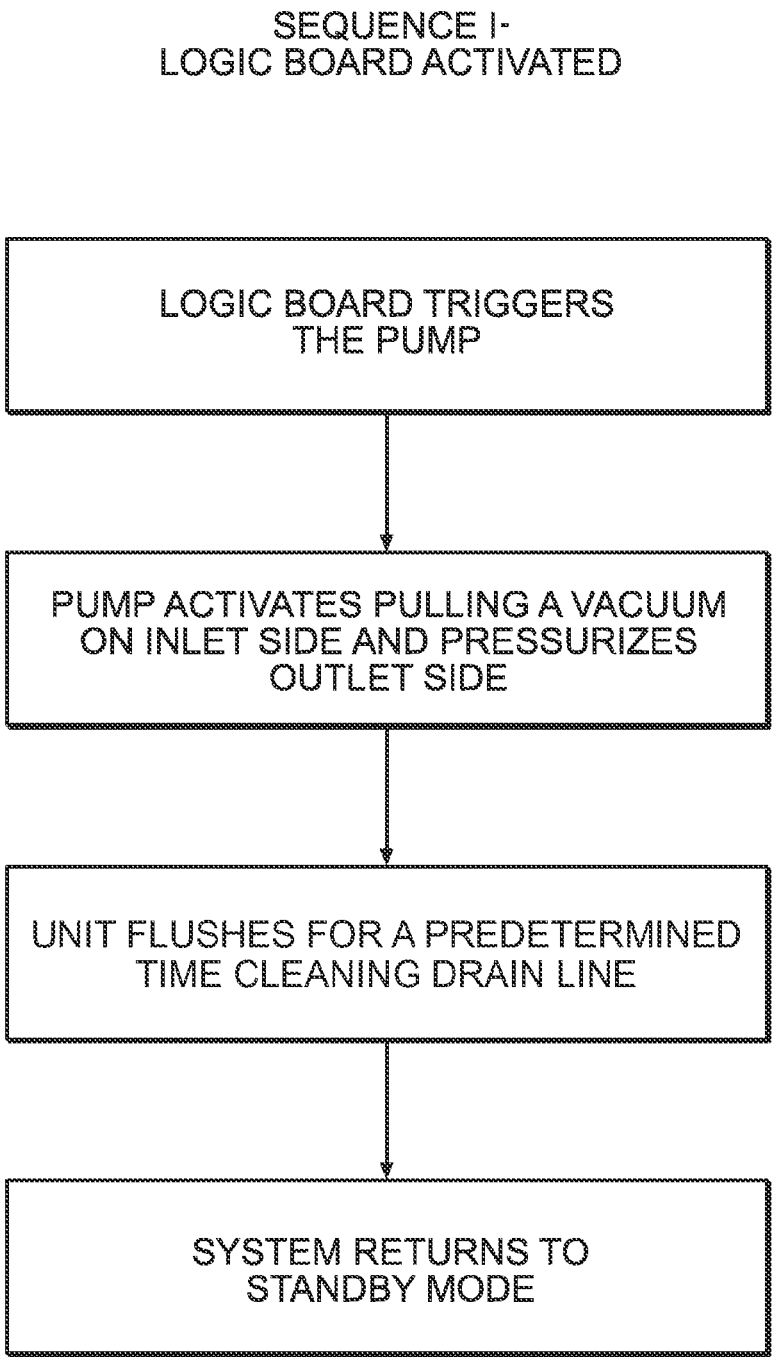
FIG. 15 is a logic flow chart of a logic panel according to an embodiment.

Referring now to FIGS. 15-18, various operating sequences according to embodiments are illustrated. Referring now to FIG. 15, the operating sequence of the ICM 1 is illustrated according to a preprogrammed or predetermined maintenance schedule. For example, the logic panel 71 may be programmed to activate the ICM 1 to flush the drainage system 17 every 48 hours. It is foreseen that the logic panel 71 may be programmed to activate the ICM 1 to flush the drainage system 17 periodically at regular (e.g. every 48 hours) or irregular time intervals (e.g. increasingly short intervals between flushes). According to the predetermined time interval, the logic board 71 activates the pump 59 to the ON position or flushing mode. As explained above, the pump 59 creates a negative pressure or vacuum at the ICM inlet 51 and a positive pressure at the ICM outlet 53 thereby flushing the drainage system 17. The ICM 1 continues flushing the drainage system 17 for approximately one minute, or any other predetermined time period, to clean the drainage system 17 of zooglea, buildup, or other debris while the air conditioning unit 3 operates normally. Thereafter, the logic panel 71 deactivates the pump 59 and returns it to the standby mode.

During periodic or scheduled flushing of the drainage system 17, the logic panel 71 may be configured to leave the compressor of the air conditioning system in the operating condition at the time of the periodic flushing. For example, the logic panel 71 may be configured not to alter the state of the compressor (energized or de-energized) during the periodic flushing. According to other embodiments, the logic panel 71 may be configured to de-energize the compressor of the air conditioning system during flushing of the drainage system 17 in order to prevent condensate or fluid overflow from the condensate drain pan 15. For example, if the flushing is sustained for longer than a predetermined period of time, the logic panel may be configured to de-energize the compressor in order to stop fluid flow into the drainage system 17. However, by not altering the state of the compressor, the air conditioning provided by the air conditioning unit 3 is not affected by a user activated flush.

Figure 16:
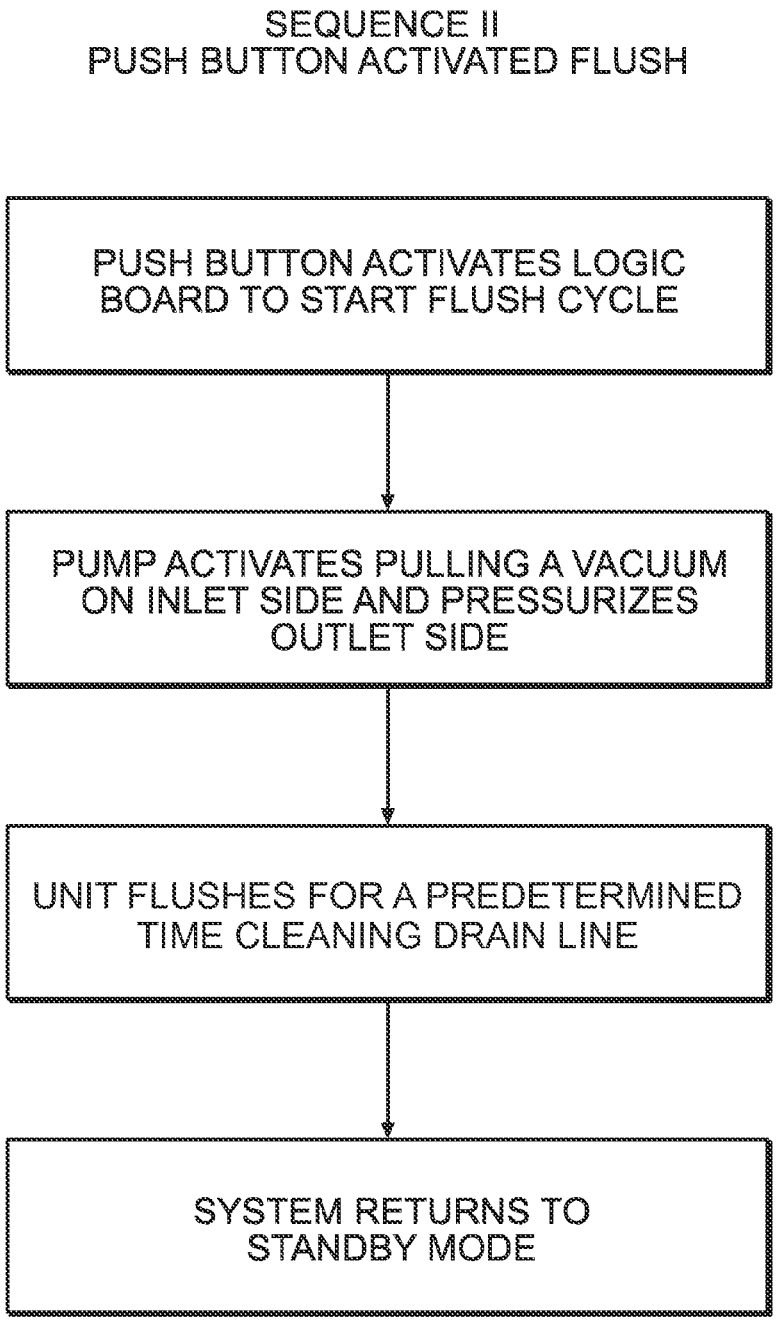
FIG. 16 is a logic flow chart of a logic panel according to an embodiment.

Referring now to FIG. 16, the operating sequence of the ICM 1 is illustrated according to a user activated switch or push button activated flush. Upon a user manually pushing a button on the ICM 1 or remotely activating the ICM 1, the logic panel 71 activates the pump 59 to the ON position or flushing mode. As explained above, the pump 59 creates a negative pressure or vacuum at the ICM inlet 51 and a positive pressure at the ICM outlet 53 thereby flushing the drainage system 17. The ICM 1 continues flushing the drainage system 17 for approximately one minute, or any other predetermined time period, to clean the drainage system 17 of zooglea, buildup, or other debris while the air conditioning unit 3 operates normally. According to an embodiment, the ICM 1 flushes for only the duration that a user holds down the user activated switch. Thereafter, the logic panel 71 deactivates the pump 59 and returns it to the standby mode.

During a user activated flush of the drainage system 17, the logic panel 71 may be configured to leave the compressor of the air conditioning system in the operating condition at the time of the periodic flushing. For example, the logic panel 71 may be configured not to alter the state of the compressor (energized or de-energized) during the user activated flushing. Similar to the during a periodic flushing, the logic panel 71 may be configured to de-energize the compressor of the air conditioning system during flushing of the drainage system 17 in order to prevent condensate or fluid overflow from the condensate drain pan 15. However, by not altering the state of the compressor, the air conditioning provided by the air conditioning unit 3 is not affected by a user activated flush.

Figure 17:
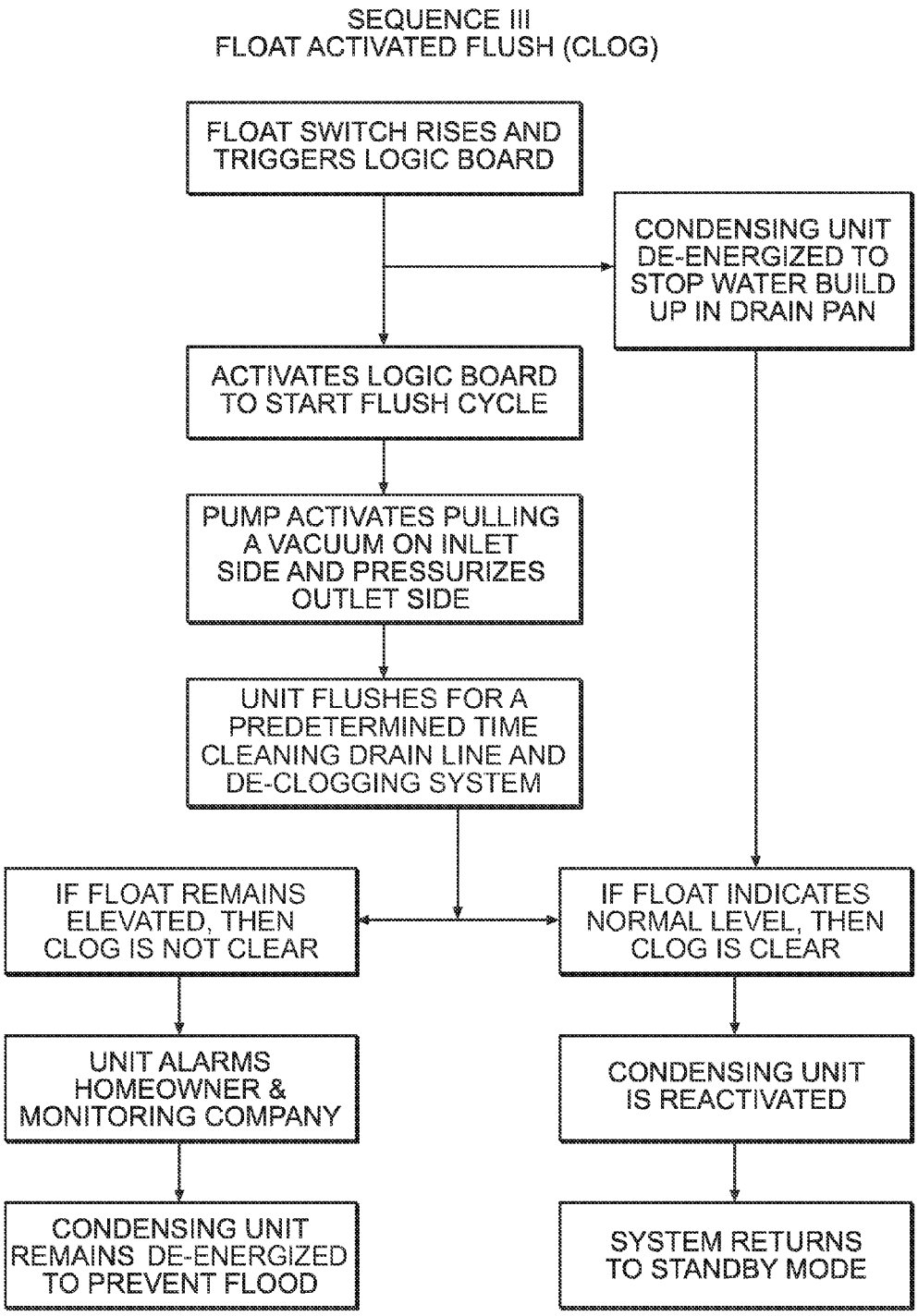
FIG. 17 is a logic flow chart of a logic panel according to an embodiment.
Figure 18:
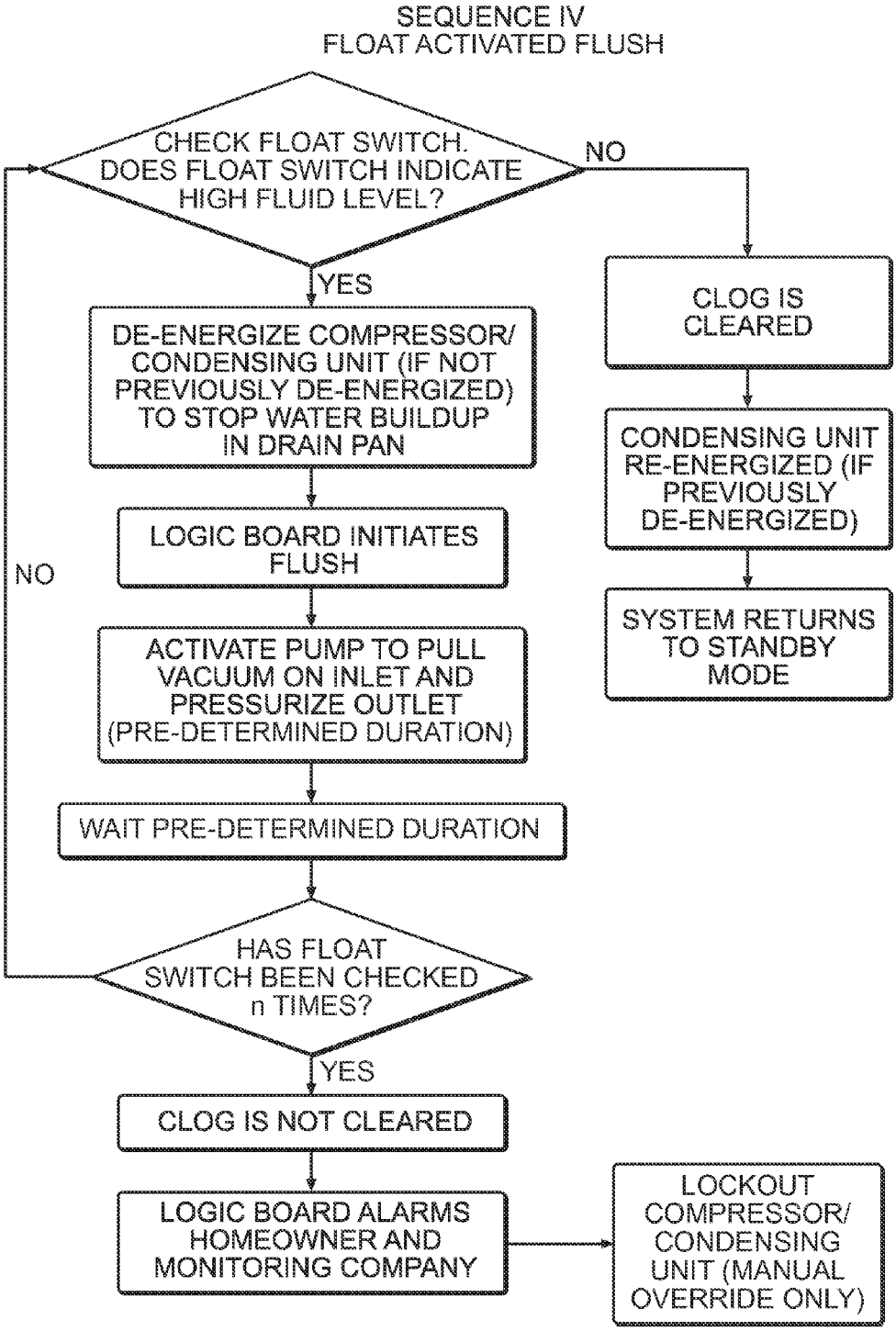
FIG. 18 is a logic flow chart of a logic panel according to an embodiment.

Referring now to FIGS. 17 and 18, the operating sequence of the ICM 1 is illustrated according to being activated by the float switch 91, or, alternatively, the water sensor. When the float switch 91 is elevated by a high condensate level in the drain pan 15 or other location, the logic panel 71 is alerted to the high condensate level. The logic panel 71 may de-energize the compressor (not shown) to stop condensate build up in the drain pan 15 in order to avoid overflow. Simultaneously or a period of time thereafter, the logic panel 71 activates the pump 59 to the ON position or flushing mode. As explained above, the pump 59 creates a negative pressure or vacuum at the ICM inlet 51 and a positive pressure at the ICM outlet 53 thereby flushing the drainage system 17. The ICM 1 continues flushing the drainage system 17 for approximately one minute, or any other predetermined time period, to clean the drainage system 17 of zooglea, buildup, or other debris while the compressor of the air conditioning unit 3 is de-energized. After the ICM 1 flushes the drainage system 17 for approximately one minute, the logic panel 71 checks the float switch 91 immediately after the flush or a predetermined time after the flush, such as, for example, 2 minutes, to ascertain the condensate level in the drain pan 15.

If the float switch 91 indicates that the condensate level in the drain pan 15 is at a normal level, the logic panel 71 determines that the clog or obstruction in the drainage system 17 is cleared. Next, the logic panel 71 re-energizes the compressor to return the air conditioning unit 3 to normal operations and returns the ICM 1 to standby mode.

If the float switch 91 indicates that the condensate level in the drain pan 15 remains at an elevated level, the logic panel 71 determines that the clog or obstruction in the drainage system 17 is not cleared. According to an embodiment, the logic panel 71 may re-activate or energize the pump 59 to the ON position or flushing mode to attempt to clear the clog or obstruction in the drainage system. After each attempt the logic panel 71 may check the float switch 91 to determine the condensate level in the drain pan 15. If the float switch 91 indicates that the condensate level in the drain pan 15 is at a normal level after any subsequent attempt, the logic panel 71 determines that the clog or obstruction in the drainage system 17 is cleared. Next, the logic panel 71 reactivates the compressor to return the air conditioning unit 3 to normal operations and returns the ICM 1 to standby mode.

If, after a predetermined number of attempts n, such as, for example, the third attempt, or after only one attempt, to clear the clog or obstruction, the float switch 91 indicates that the condensate level in the drain pan 15 remains at an elevated level, the logic panel 71 may alert the user, homeowner, and/or monitoring company of the high condensate level in the drain pan 15. In order to prevent damage to the air conditioning unit 3, the logic panel 71 may keep the compressor de-energized. The logic panel 71 may additionally alert the user, homeowner, and/or monitoring company according to various alarm codes such as, for example, low battery, high condensate level, presence of water sensed by a water sensor (not shown), or a stuck float switch. According to an embodiment, the logic panel 91 may lock out the compressor from being re-energized so that only a manual override may re-energize the compressor.

The logic panel 71 may be further configured to determine that a clog or obstruction remains in the drainage system 15 after successfully clearing a clog, as explained above. According to an embodiment, if the float switch 91 indicates that the condensate level in the drain pan 15 returns to an elevated level a predetermined number of times within a predetermined amount of time after successfully clearing a clog or obstruction, the logic panel 71 may determine that a substantial clog or obstruction remains in the drainage system. For example, if the float switch 91 indicates that the condensate level in the drain pan 15 returns to an elevated level once, twice, or three times within an hour after successfully clearing a clog or obstruction, the logic panel 71 may determine that a substantial clog or obstruction remains in the drainage system. For example, the substantial clog or obstruction may all only a small amount of condensate flow through the drainage system. After determining that a substantial clog or obstruction remains in the drainage system, the logic panel 71 may initiate an additional sequence to clear the clog or obstruction, as illustrated at FIG. 17 and/or FIG. 18. The logic panel 71 may alternatively or additionally be configured to de-energize the compressor of the air conditioning system in order to stop flow of condensate into the drainage system and/or alert the user or monitoring company.

According to an embodiment, the float switch 91 alerts the logic panel 71 of a high condensate level on a first motion of being elevated to a predetermined condensate level. Once the logic panel 71 is alerted of the high condensate level, the logic panel 71 operates as described above according to the sequence of FIG. 17, for example. By alerting the logic panel 71 on the first motion of being elevated to a predetermined condensate level, the logic panel 71 may de-energize the compressor such that the float switch 91 avoids causing the compressor to jump start or short cycle on and off if, for example, the float switch bounces above and below the predetermined condensate level. Moreover, by de-energizing the compressor when a high fluid or condensate level is detected in the drain pan, fluid flow may be prevented into the drainage system thus preventing overflow and/or other damage from continued flow of condensate into the drainage system.

In still other embodiments, an ICM 1 may be provided with no logic panel triggered by a float switch. In such an embodiment, the ICM 1 may be activated, for example, by the sequences described by FIG. 15 or FIG. 16 or by both.

Wiring Diagram and Alerts

Figure 19:
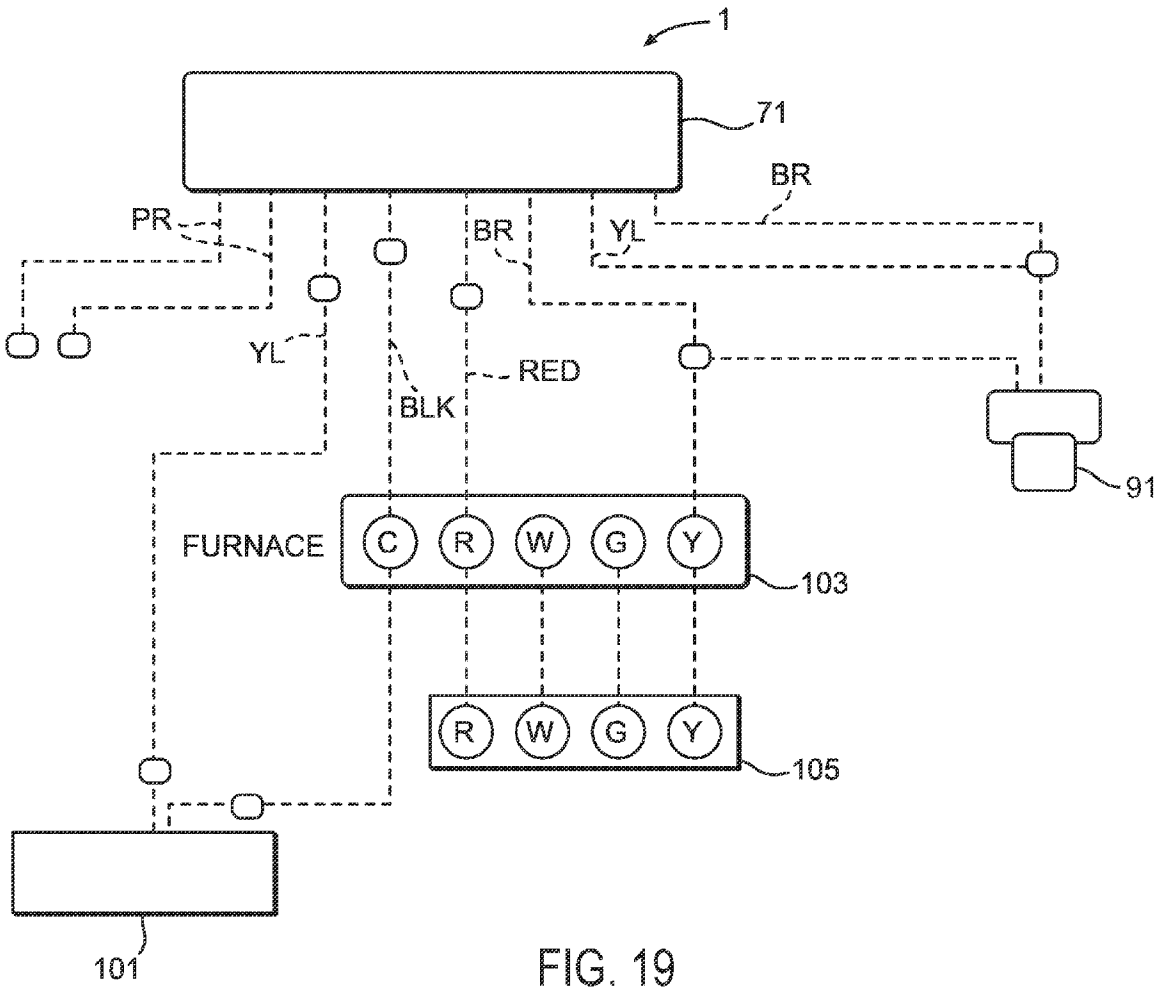
FIG. 19 is a wiring diagram of the intelligent condensate management system integrated into a heating, ventilation, and air conditioning system according to an embodiment.

Referring now to FIG. 19, the ICM 1 may be wired from the logic board 71 to a user's or homeowner's heating, ventilation, and air conditioning system and alarm system. For example, the wires PR may be used on a security monitoring system, alarm system, or alternate device. The wires PR may form normally closed circuit or have continuity through the logic panel 71 under normal operating conditions of the air conditioning unit 3. However, if the logic panel 71 is alerted to an abnormal operating condition, such as a flooding or overflow condition, the circuit of wires PR opens thereby indicating the condition to the security monitoring system, alarm system, or alternate device.

The wire Y may be wired from the logic panel 71 to a compressor relay 101 to deliver 24-volt alternating current from the furnace 103 or air handler transformer (not shown) via wire BLK through the logic panel 71 to the compressor. Under normal operating conditions, the wire Y sends control current to operate the compressor. However, if the logic panel 71 is alerted to an abnormal operating condition, such as a flooding or overflow condition, the logic board 71 will lock out the control current to de-energize the compressor.

The wire B may be wired from the ICM logic panel 71 to the common terminal C of the furnace 103 or air handler 5. The wire B supplies the neutral or common side of the 24-volt alternating current circuit to the compressor relay 101. The wire B is also used to power the logic panel 71, charge the battery 77, and supply current to operate electronics within the logic panel 71.

The wire RED may be wired from the ICM logic panel 71 to the R terminal on the furnace 103 or air handler 5. The wire RED supplies the hot or low 24-volt alternating current supply from a transformer (not shown) within the furnace 103 or air handler 5. The wire RED completes the circuit with the wire B, described above, to power the logic panel 71, charge the battery 77, and supply current to operate electronics within the logic panel 71.

The wire W connects the furnace 101 or air handler 5 to thermostat 105 to call for heat at the furnace 101 or air handler 5.

The wire G connects the furnace 101 or air handler 5 to thermostat 105 to call for fan operation at the furnace 101 or air handler 5.

The wire Y connected to terminal Y of the furnace 101 or air handler 5 and terminal Y of thermostat 105 may be energized when the thermostat 105 closes the circuit within the thermostat 105 to call for air conditioning when temperature rises to above a predetermined level. The hot or low 24-volt alternating current flow via wire Y to a wire BR of the logic panel 71 and float switch 91. The wires BR and YL between the terminals Y of the thermostat 105 and furnace 103 or air handler 5 are normally closed under normal operating conditions. Therefore, under normal operating conditions when the float switch 91 is below a predetermined level, current flows through the float and other wire BR leaving the float switch 91. Current then flows into the wire YL and the wire BR to the logic panel 71. The wire YL passes current through the logic panel 71 and back to the wire YL to the compressor relay 101 to complete the control circuit. However, if the logic panel 71 is alerted to an abnormal operating condition, such as a flooding or overflow condition, the logic panel 71 will open the circuit to de-energize the compressor. Similarly, as the float switch 91 rises above a predetermined level, the float switch 91 will open the circuit to the logic panel 71 and break the 24-volt alternating current to the logic board 71. Additionally, the logic board 71 energizes the pump 59 to flush the drainage system 17, as described above.

Figure 20:
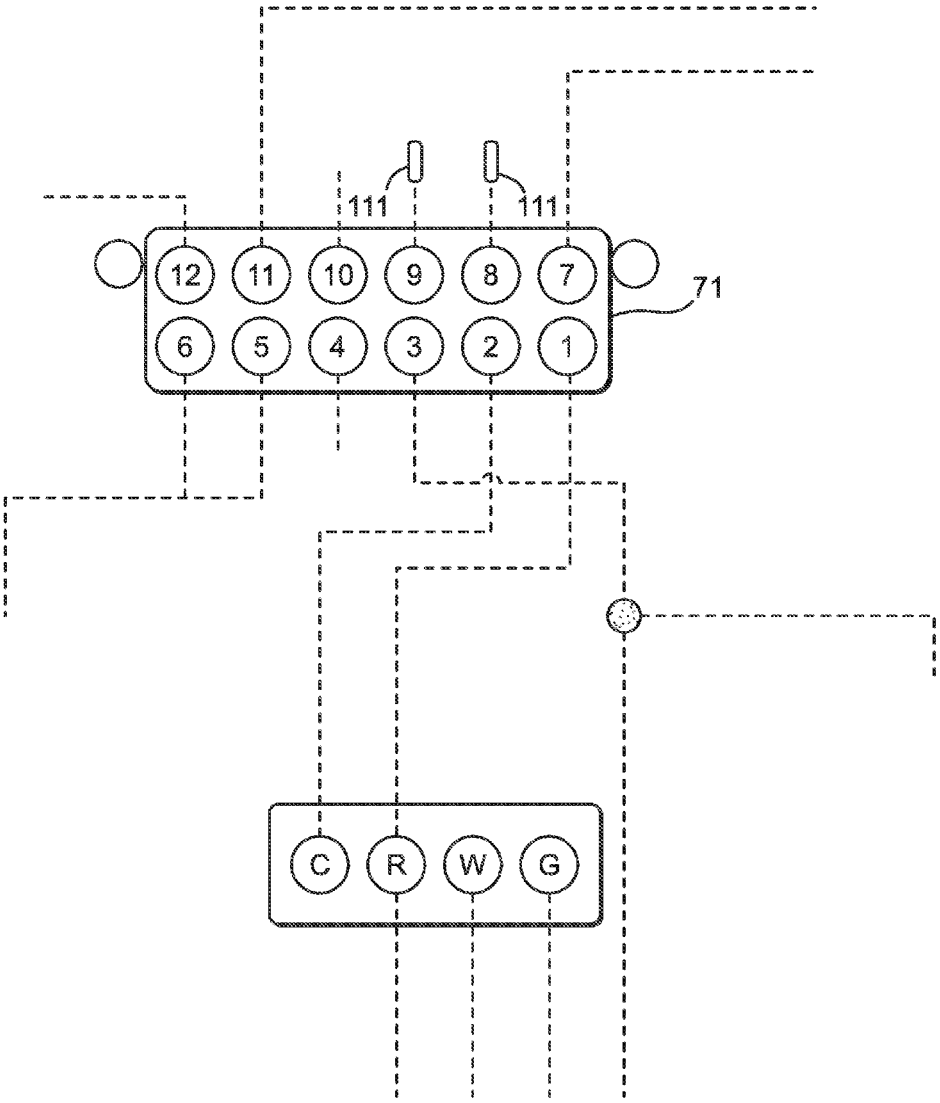
FIG. 20 is a wiring diagram of the intelligent condensate management system integrated into a heating, ventilation, and air conditioning system including a water sensor according to an embodiment.

Referring now to FIG. 20, the logic board 71 of the ICM 1 may be additionally wired with a water sensor 111. According to an embodiment, the water sensor wires 111 are additionally connected to terminals of the logic board 71. Each water sensor wire 111 is placed apart from the other such that presence of a conductive fluid, such as condensate, will alert the logic board 71 of the presence of liquid.

Flush Line Configuration

Figure 21:
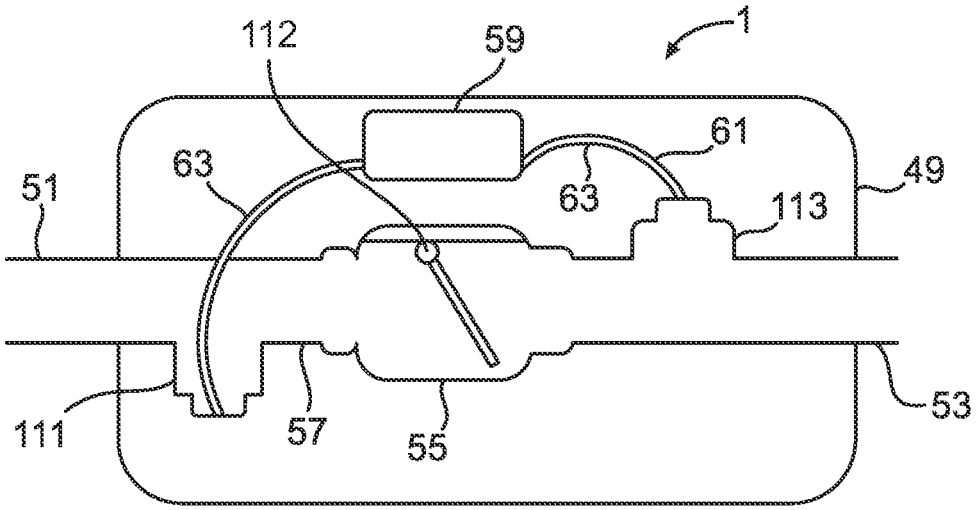
FIG. 21 is a condensate management system according to an embodiment.

Referring now to FIG. 21, another embodiment of the ICM 1 is illustrated. Similar to FIG. 10, an embodiment of the ICM 1 is shown generally comprising the ICM housing 49 having the ICM inlet 51, the ICM outlet 53, the check valve 55 in the ICM primary condensate flow line 57, and the pump 59 in the ICM flush line 61. The ICM flush line 61 may connect to the upstream drainage portion 23 and/or the downstream drainage portion 25 while maintaining a parallel relationship with the ICM primary condensate flow line 57.

The pump inlet 111 to the ICM flush line 61 may be arranged at a lower portion of the ICM inlet 51 such that the pump inlet 111 is below a condensate or fluid level in the ICM inlet 51. According to an embodiment, the pump inlet 111 may be a port or a bull opening on a tee from the ICM inlet 51 in order to create a space under the ICM inlet 51 to collect a reservoir of condensate or fluid from the drainage system 17. According to an embodiment, the pump inlet 111 may be arranged at the lowermost portion of the ICM inlet 51. As condensate or fluid gravity drains away from the drain pan 15 and into the drainage system 17, a reservoir of condensate or fluid may be formed at the ICM inlet 51 and in the pump inlet 111 of the ICM flush line 61. According to an embodiment, the pump inlet 111 is always submerged in condensate or fluid when fluid is in the drainage system 17.

Referring again to FIG. 6, the length and/or diameter of the upstream drainage portion 23 piping may be increased in order to increase the volume of water trapped in the upstream drainage portion 23. For example, during normal drainage through the upstream drainage portion 23, an increased volume of water trapped in the upstream drainage portion 23 is available to the 59 of the ICM 1. According to this embodiment, fluid trapped in the upstream drainage portion 23 will be available for pumping and/or sustained pumping through the pump 59 of the ICM during normal fluid flow through the condensate drainage system as well as when an obstruction clogs flow in the condensate drainage system. In other configurations of the upstream drainage portion 23, such as when no water is trapped, no water may be available for pumping through the pump 59 of the ICM 1.

The pump outlet 113 of the ICM flush line 61 may be arranged at an upper portion of the ICM outlet 53. According to an embodiment, the pump outlet 113 may be arranged at the uppermost portion of the ICM outlet 53. According to an embodiment, the condensate or fluid level may be below the pump outlet 113 in order to reduce backpressure on or backflow to the pump 59.

When the pump 59 is activated, such as by an operating sequence, as explained above, the pump 59 may immediately draw in water from the pump inlet 111 submerged in condensate or fluid. The immediate draw of condensate or fluid may quickly and efficiently prime the pump and more quickly create a pressure differential to seal the check valve 55.

According to another embodiment, the pump inlet 111 may be further configured to hold a predetermined amount of fluid based on the pump capacity of the pump 59. For example, if the pump 59 pumps fluid at 1 liter/minute and the pump will cycle for 1 minute, the pump inlet 111 may be sized to contain at least a volume equal to or greater than 1 liter of fluid. According to other embodiments, the pump inlet 111 may be outside the housing of the ICM. Similarly, according to another embodiment, the piping of the upstream drainage portion 23 containing fluid, as set, for example, by the elevation of the downstream trap 37 (see e.g., FIG. 2), may be sized based on the pump capacity of the pump 59.

Figure 24:
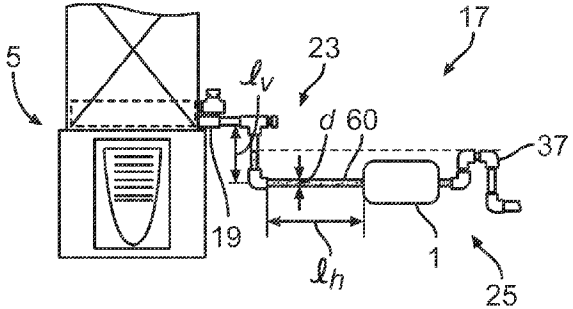
FIG. 24 is a plan view of a drainage system having an intelligent condensate management system according to an embodiment.
Figure 27:
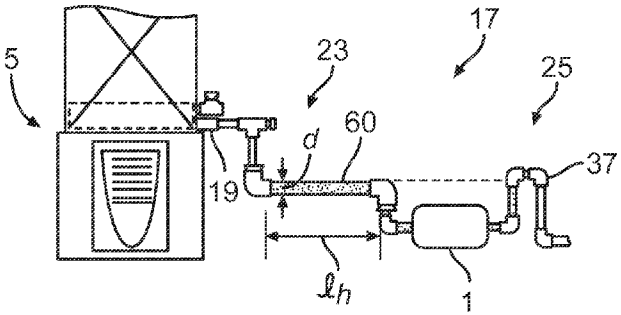
FIG. 27 is a plan view of a drainage system having an intelligent condensate management system according to an embodiment.
Figure 26:
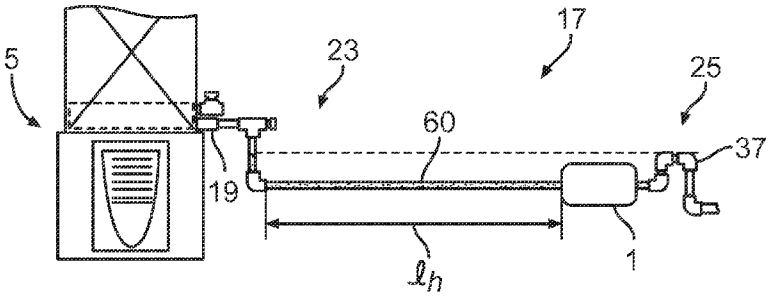
FIG. 26 is a plan view of a drainage system having an intelligent condensate management system according to an embodiment.

Referring to FIGS. 24-29, various configurations of the drainage system 17 are illustrated. Referring now to FIGS. 24-27, a horizontal portion 60 of the upstream drainage portion 23 may be sized to hold a predetermined amount of fluid. According to an embodiment, the length l may be modified so that a predetermined volume of fluid is contained therein. For example, the length $l_h$ illustrated at FIG. 24 may be 2 feet, the length t illustrated at FIG. 25 may be 4 feet, and the length $l_h$ illustrated at FIG. 26 may be 11 feet. Alternatively or in combination with any of length $l_h$, the diameter d of the horizontal portion 60 may be modified so that a predetermined volume of fluid may be contained therein. For example, the length $l_h$ may be 2 feet as illustrated at FIGS. 24 and 27 and the diameter d may be increased from 0.75 inch, as illustrated at FIG. 24, to 1.5 inches or more, as illustrated at FIG. 27.

Figure 28:
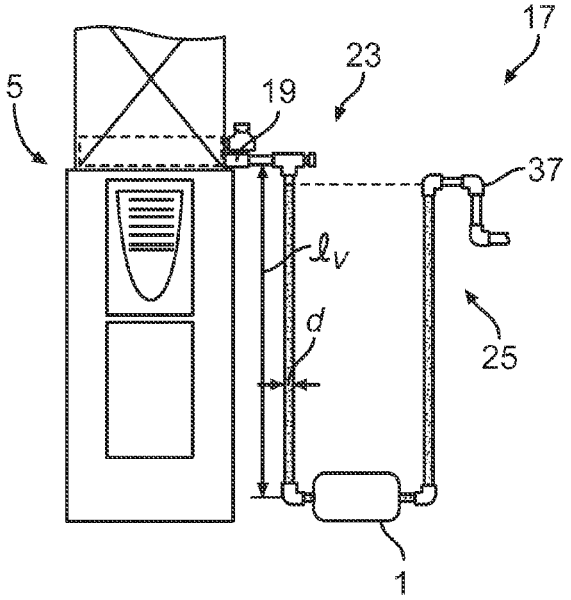
FIG. 28 is a plan view of a drainage system having an intelligent condensate management system according to an embodiment.
Figure 29:
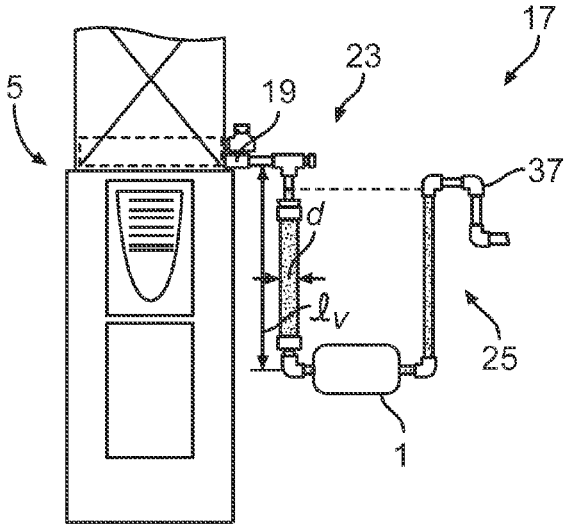
FIG. 29 is a plan view of a drainage system having an intelligent condensate management system according to an embodiment.

Referring now to FIGS. 24, 28, and 29, the vertical portion 62 of the upstream drainage portion 23 may be sized to hold a predetermined amount of fluid. According to an embodiment, the length $l_v$ of the vertical portion 62 may be increased from, for example, 6 inches or 1 foot, as illustrated at FIG. 24, to greater than 2 feet or 4 feet, for example, as illustrated at FIG. 28. It is further noted that in order to maintain a fluid level in the vertical portion 62, the height of the downstream trap 37 should be at a height which is lower than the drainage system inlet 19 and higher than the ICM inlet 51, for example.

Alternatively or in combination with increasing the length $l_v$ of the vertical portion 62 of the upstream drainage portion 23, the diameter d of the vertical portion 62 may be increased. For example, the diameter d of the vertical portion 62 may be 1.5 inches or more, as illustrated at FIG. 29. In such a configuration, the height of the downstream trap 37, and the corresponding liquid level in the upstream drainage portion 23, may be lowered away from the drainage system inlet 19 while maintaining a large predetermined fluid capacity in the upstream drainage portion 23. In the event of a clog which causes a rising of liquid level in the upstream drainage portion 23, such a configuration with liquid level in the upstream drainage portion 23 spaced relatively farther from the drainage system inlet 19 may increase the time required for the rising liquid level to overflow in the air handler 5.

It is foreseen that any combination of different diameters d, lengths $l_h$, and lengths $l_v$ may be used in order to size the fluid volume of the upstream drainage portion 23.

Inlet Tee Configuration

Figure 22:
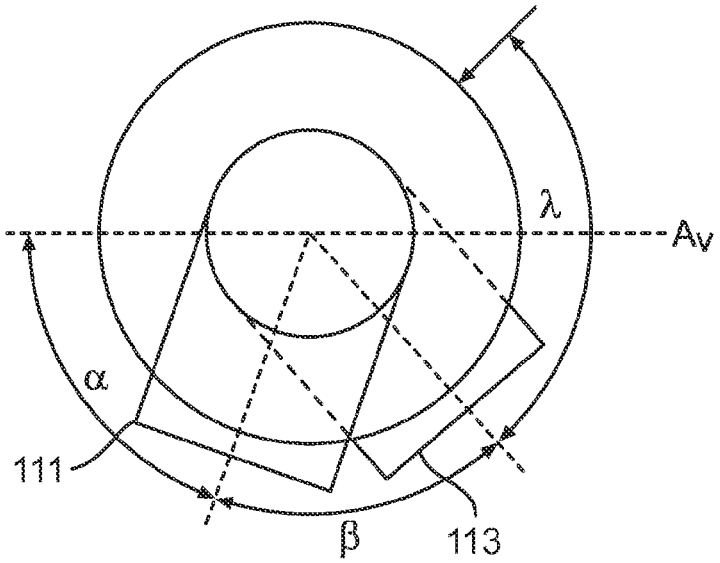
FIG. 22 is a section view A-A of FIG. 2 in a wall mount installation position.
Figure 23:
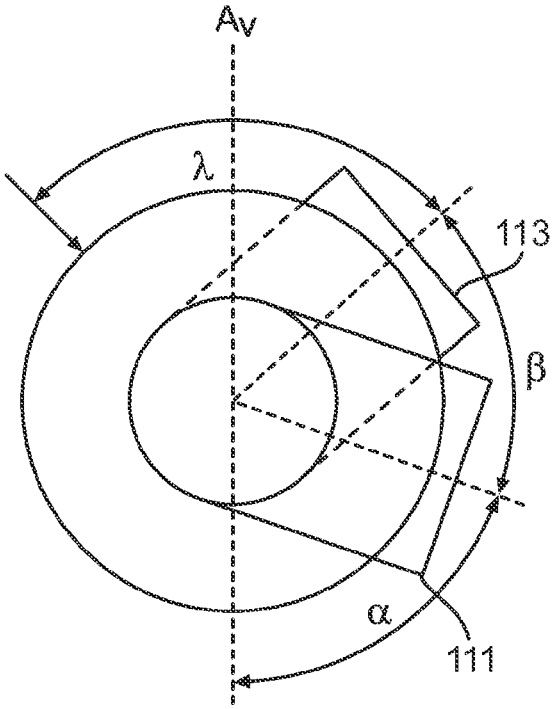
FIG. 23 is a section view A-A of FIG. 2 in a floor mount installation position.
Figure 25:
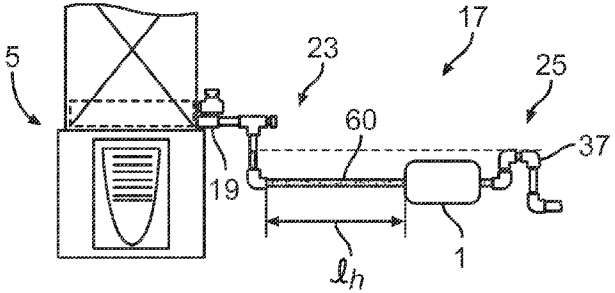
FIG. 25 is a plan view of a drainage system having an intelligent condensate management system according to an embodiment.

Referring now to FIGS. 22 and 23, the position of the pump inlet 111, pump outlet 113, and a hinge 112 (FIG. 21) of a flapper-type check valve 55 is illustrated relative to a vertical axis $A_v$ when the ICM 1 is viewed from A-A on FIG. 2. FIG. 22 is the ICM 1 in a wall mount installation position. FIG. 23 is the ICM 1 in a floor mount installation position. The pump inlet 111 may be located at an angle $\alpha$ from the vertical axis $A_v$ in a range, for example of 0°23 $\alpha \leq 90°$. According to other embodiments, the range may be, for example, 0°23 $\alpha \leq 80°$, 0°23 $\alpha \leq 70°$, 0°23 $\alpha \leq 45°$, or $30° \leq \alpha \leq 60°$. The pump outlet 113 may be located at an angler $\beta$ from the pump inlet 111. While the pump outlet 113 may be located at $\alpha+\beta>90°$, the pump outlet 113 may also be located at $\alpha+\beta \leq 90°$. The angler $\beta$ may be in a range of $0° \leq \beta \leq 90°$ from the pump inlet 111. Similarly, the hinge of the flapper-type check valve 55 may be located at an angle $\lambda$ from the pump outlet 113. The angle $\lambda$ may be in a range of $0° \leq \lambda \leq 90°$ from the pump outlet 113.

In order to determine the optimal positions of the pump inlet 111 and hinge of the hinge of the flapper-type check valve 55, various configurations were tested, as illustrated in Table 1.

TABLE 1

| TEST | PRESSURE REQUIRED TO CLOSE CHECK VALVE (PSI MAX) | POSITION OF CHECK VALVE HINGE ($\alpha+\beta+\lambda$) | POSITION OF INLET TEE [$\alpha$] | TOTAL NUMBER OF TRAILS | TIME REQUIRED FOR CHECK VALVE TO CLOSE (t seconds) $t \leq 2$ | $2 < t \leq 10$ | $10 < t \leq 60$ | NO CLOSE | COMMENTS |
|---|---|---|---|---|---|---|---|---|---|
| 1 | 8 | 135 degrees | 135 degrees | 50 | 49 | 0 | 1 | 0 | |
| 2 | 8 | 135 degrees | 135 degrees | 30 | 30 | 0 | 0 | 0 | AIR INTAKE NOTED |
| 3 | 8 | 135 degrees | 135 degrees | 30 | 30 | 0 | 0 | 0 | AIR INTAKE NOTED |

TABLE 1-continued

| TEST | PRESSURE REQUIRED TO CLOSE CHECK VALVE (PSI MAX) | POSITION OF CHECK VALVE HINGE ($\alpha+\beta+\lambda$) | POSITION OF INLET TEE [$\alpha$] | TOTAL NUMBER OF TRAILS | TIME REQUIRED FOR CHECK VALVE TO CLOSE (t seconds) $t \leq 2$ | $2 < t \leq 10$ | $10 < t \leq 60$ | NO CLOSE | COMMENTS |
|---|---|---|---|---|---|---|---|---|---|
| 4 | N/A | 225 degrees | 135 degrees | 22 | 5 | 0 | 0 | 17 | |
| 5 | N/A | 225 degrees | 45 degrees | 6 | 6 | 0 | 0 | 0 | INLET TEE ROTATED FROM TEST 4 (same valve as in test 4) |
| 6 | 10 | 225 degrees | 135 degrees | 10 | 0 | 0 | 0 | 10 | |
| 7 | 10 | 225 degrees | 45 degrees | 2 | 2 | 0 | 0 | 0 | INLET TEE ROTATED FROM TEST 6) (same valve as in test 5) |
| 8 | 10 | 225 degrees | 135 degrees | 5 | 5 | 0 | 0 | 0 | INLET TEE ROTATED AGAIN FROM TEST 7 (same valve as in tests 5 and 6) |
| 9 | 10 | 225 degrees | 135 degrees | 10 | 2 | 2 | 2 | 4 | |
| 10 | 8 | 50 degrees | 135 degrees | 25 | 8 | 17 | 0 | 0 | |
| 11 | 10 | 225 degrees | 135 degrees | 10 | 0 | 4 | 6 | 0 | AIR INTAKE NOTED ON ALL TESTS |
| 12 | 10 | 225 degrees | 45 degrees | 5 | 5 | 0 | 0 | 0 | NO AIR INTAKE NOTED ON ANY TESTS |
| 13 | 8 | 225 degrees | 135 degrees | 10 | 6 | 2 | 2 | 0 | AIR INTAKE NOTED ON ALL TESTS |
| 14 | 8 | 225 degrees | 45 degrees | 7 | 4 | 3 | 0 | 0 | AIR INTAKE NOTED ONLY ON 3 TESTS > 1 SEC |
| 15 | 4 | 225 degrees | 135 degrees | 10 | 10 | 0 | 0 | 0 | AIR INTAKE NOTED ON 5 TESTS |
| 16 | N/A | 225 degrees | 45 degrees | 5 | 5 | 0 | 0 | 0 | NO AIR INTAKE NOTED ON ANY TESTS |

Table 1 summarizes test results of the effect of the position of the pump inlet 111 (or inlet tee), the position of the hinge of a flapper type check valve 55, and the pressure required to close the check valve 55 on the time required to close the check valve 55. Various inlet tee positions and pressures required to close the check valve were tested in order to determine a configuration to minimize the time required to close the check valve and reduce a failure rate indicated by the NO CLOSE result. The position of the inlet tee a was generally set to 135° or a position of the inlet tee that was not submerged in condensate, and 45° or a position of the inlet tee that was submerged in condensate. Regarding the position defined by angle $\beta$, the position of the outlet tee may be independent of the position of the inlet tee and check valve hinge.

The position of the check valve hinge was set where $\alpha+\beta+\lambda$ was approximately at 135° or 225°, however, the position of the check valve may be independent of the position of the inlet tee and outlet tee. For example, the check valve hinge may be approximately at 135° or 225° from the bottom of the vertical axis $A_v$. In other terms, the position of the check valve hinge may vary approximately 45° on either side from the top of the vertical axis $A_v$. For example, the position of the check valve hinge may be in a non-submerged position during normal flow through the drainage system.

The inventors have discovered that when the pressure required to close the check valve is greater than 8 psi, such as, for example, 10 psi or more, the position of the inlet tee is critical to reducing the time required to close the check valve and/or reduce a failure rate indicated by the NO CLOSE result. For example, when the position of the inlet was set approximately to $\alpha$=45° or at a submerged position, 100% of tests indicated that the check valve closed in under 2 seconds. However, when the position of the inlet was set approximately to $\alpha$=135°, 20% of tests indicated that the check valve closed in under 2 seconds, and 40% of tests resulted in no closure of the check valve.

The inventors have further discovered that when the pressure required to close the check valve was 8 psi or less, the position of the inlet tee is less of an indicator of the failure or NO CLOSE result. When the position of the inlet was set approximately to $\alpha$=135° or the non-submerged position, 84% of tests indicated that the check valve closed in under 2 seconds, and 0% of tests resulted in no closure of the check valve.

When the pressure required to close the check valve was 4 psi or less, 100% of the tests indicated that the check valve closed in under 2 seconds.

Irrespective of pressure required to closed the check valve, the inventors discovered significant improvement of the check valve closure times when the inlet tee was submerged, as shown in Table 2. In particular, the non-submerged inlet tee resulted in total failure in 10% of tests. The submerged inlet tee position little to no failure rate.

TABLE 2

| | TIME REQUIRED FOR CHECK VALVE TO CLOSE (t, SECONDS) | | | |
|---|---|---|---|---|
| | $t \leq 2$ | $2 < t \leq 10$ | $10 < t \leq 60$ | NO CLOSE |
| Non-submerged inlet tee | 76% | 9% | 4% | 10% |
| Submerged inlet tee | 88% | 12% | 0% | 0% |

Therefore, according to an embodiment, the inlet tee may be positioned in a submerged position. As explained above, the submerged position may be at an angle $\alpha$ from the vertical axis $A_v$ in a range, for example of $0° \leq \alpha \leq 90°$ and various angles therebetween as described above.

The embodiments illustrated and discussed in this specification are intended only to teach those skilled in the art the best way known to the inventors to make and use the invention. Nothing in this specification should be considered as limiting the scope of the present invention. All examples presented are representative and non-limiting. The above-described embodiments of the invention may be modified or varied, without departing from the invention, as appreciated by those skilled in the art in light of the above teachings. It is therefore to be understood that, within the scope of the claims and their equivalents, the invention may be practiced otherwise than as specifically described.

We claim:

1. A condensate management system for a condensate drain, the condensate management system comprising:

an inlet and an outlet;

a primary condensate flow path from the inlet to the outlet a check valve disposed along the primary condensate flow path;

a flush path from the inlet to the outlet that is different than the primary condensate flow path;

a pump coupled in or on the flush path; and a logic panel configured to detect a condition for flushing and to actuate the pump between a flushing mode and a standby mode based on the condition for flushing;

wherein the check valve is configured to allow fluid flow from the inlet to the outlet;

wherein when the pump is actuated to the flushing mode, the pump is configured to exert a negative pressure at the inlet and a positive pressure at the outlet, wherein the negative pressure at the inlet and the positive pressure at the outlet closes the check valve.

2. The condensate management system of claim 1, wherein the flush path is substantially in parallel with the primary condensate flow path.

3. The condensate management system of claim 1, wherein the flush path further comprises a flush line check valve.

4. The condensate management system of claim 1, wherein the flush path further comprises a flush path inlet fluidly connected to the inlet and a flush path outlet fluidly connected to the outlet, wherein the flush path inlet fluidly connects to a lower portion of the inlet.

5. The condensate management system of claim 1, wherein the logic panel is configured to detect a predetermined condensate level in a drain pan of an air conditioner.

6. The condensate management system of claim 5, wherein the logic panel is further configured to de-energize a compressor of the air conditioner in order to prevent condensate overflow of the drain pan.

7. The condensate management system of claim 5, wherein the logic panel is further configured to actuate the pump to the flushing mode after the predetermined condensate level in the drain pan is detected.

8. The condensate management system of claim 5, wherein the logic panel is further configured to actuate the pump to the standby mode and determine a condensate level in the drain pan after the pump is actuated to the standby mode.

9. The condensate management system of claim 1, wherein the logic panel is configured to actuate the pump at predetermined time intervals for a predetermined time period.

10. A condensate management system for purging and cleaning an air conditioning condensate drainage system, the condensate management system comprising:

a housing having a housing inlet and a housing outlet;

a primary condensate flow line from the housing inlet to the housing outlet;

a flush line having a pump, a flush line inlet, and a flush line outlet, wherein the flush line inlet is connected to the housing inlet, and the flush line outlet is connected to the housing outlet, wherein the pump is provided in or on the flush line and is configured to pump from the flush line inlet to the flush line outlet;

wherein the pump is configured to be actuated between a standby mode and a flushing mode by a controller in order to create a negative pressure at the housing inlet and a positive pressure at the housing outlet during the flushing mode.

11. The condensate management system of claim 10, wherein the controller is configured to sense a condition to actuate the pump from the standby mode to the flushing mode.

12. The condensate management system of claim 11, wherein the condition to actuate the pump from the standby mode to the flushing mode is one of a flooding condition, a clog in the condensate drainage system, a scheduled flush, or a user-actuated flush.

13. The condensate management system of claim 11, wherein the condition for flushing comprises at least one or both of detecting an elevated condensate level in a drain pan and a predetermined time interval between flushings.

14. The condensate management system of claim 11, further comprising a check valve disposed with the primary condensate flow line, the check valve having an open position and a closed position, wherein the check valve is in the closed position during the flushing mode.

15. The condensate management system of claim 14, wherein energizing the pump further comprises energizing the pump for a predetermined time period.

16. The condensate management system of claim 15, wherein energizing the pump for the predetermined time period further comprises de-energizing and energizing the pump a predetermined number of times.

17. The condensate management system of claim 11, wherein the controller is configured to determine whether the condition for flushing the condensate drainage system is resolved.

18. The condensate management system of claim 17, wherein if the controller determines the condition for flushing is not resolved, the controller is configured to de-energize a compressor of an air conditioning system.

19. The condensate management system of claim 17, wherein if the controller determines the condition for flushing is not resolved, the controller is configured to transmit an alert.

20. The condensate management system of claim 1, the flush path comprising a flush path inlet and a flush path outlet, wherein the flush path inlet is connected to the inlet and the flush path outlet is connected to the outlet.

21. The condensate management system of claim 1, wherein the pump is coupled in or on the flush path and is configured to pump from the inlet to the outlet.

22. The condensate management system of claim 10, wherein the negative pressure at the housing inlet and the positive pressure at the housing outlet is adapted to close the check valve.

* * * * *